US009795234B2

(12) United States Patent
Higgins

(10) Patent No.: US 9,795,234 B2
(45) Date of Patent: Oct. 24, 2017

(54) SHAFT MOUNTED CUP HOLDER ASSEMBLY

(71) Applicant: GLV Consulting, Designing & Fabricating, LLC, Fayetteville, NC (US)

(72) Inventor: Vincent Higgins, Fayetteville, NC (US)

(73) Assignee: GLV CONSULTING, DESIGNING & FABRICATING, LLC, Fayetteville, NC (US)

( * ) Notice: Subject to any disclaimer, the term of this patent is extended or adjusted under 35 U.S.C. 154(b) by 0 days.

(21) Appl. No.: 14/904,219

(22) PCT Filed: Jul. 11, 2014

(86) PCT No.: PCT/US2014/046371

§ 371 (c)(1),
(2) Date: Jan. 11, 2016

(87) PCT Pub. No.: WO2015/069326

PCT Pub. Date: May 14, 2015

(65) Prior Publication Data

US 2016/0143469 A1 May 26, 2016

Related U.S. Application Data

(60) Provisional application No. 61/844,891, filed on Jul. 11, 2013.

(51) Int. Cl.
*A47G 23/02* (2006.01)
*A47G 23/06* (2006.01)
(Continued)

(52) U.S. Cl.
CPC ..... *A47G 23/0208* (2013.01); *A47B 13/16* (2013.01); *A47B 37/04* (2013.01); *A47G 23/0641* (2013.01)

(58) Field of Classification Search
CPC ..... A47G 23/0208; A47G 23/02; A47G 23/0641; A47G 23/06; A47B 13/16; A47B 37/04
(Continued)

(56) References Cited

U.S. PATENT DOCUMENTS 1,807,400 A * 5/1931 Gallagher ..... A47G 23/0208 221/121
2,805,109 A 9/1957 Kopmar
(Continued)

FOREIGN PATENT DOCUMENTS

DE 202005018913 U1 3/2006
GR 20090100435 A 2/2011

*Primary Examiner* — Robert J Hicks
(74) *Attorney, Agent, or Firm* — Nexsen Pruet, PLLC; E. Eric Mills

(57) ABSTRACT

Shaft-mounted cup holders, hole-mounted cup holders, free-standing cup holders, and tabletop cup holders and methods of assembling and using the same. Shaft-mounted cup holders, hole-mounted cup holders, freestanding cup holders, and tabletop cup holders are based on a cup holder assembly that includes, for example, a 2-cup plate or a 4-cup plate in relation to a center fastener, wherein the 2-cup plate, the 4-cup plate, and the center fastener are designed to be slidably or permanently affixed to a shaft or pole, such as the shaft or pole of a table umbrella or beach umbrella or a stand-alone shaft or pole configured for use with the cup holders.

14 Claims, 48 Drawing Sheets

(51) Int. Cl.
*A47B 13/16* (2006.01)
*A47B 37/04* (2006.01)

(58) Field of Classification Search
USPC ..... 220/737, 694, 475; 215/395, 386; 211/205; 206/564, 563, 562, 217, 216; 403/178, 175, 174, 170, 169; 248/149, 248/146
See application file for complete search history.

(56) References Cited

U.S. PATENT DOCUMENTS

| | | | | |
|---|---|---|---|---|
| 3,194,403 | A * | 7/1965 | Van Horn, Jr. | A47F 5/04 211/107 |
| 5,197,394 | A * | 3/1993 | Schmidt | A45B 23/00 108/128 |
| 5,772,050 | A * | 6/1998 | Shih | B41K 1/58 211/163 |
| 8,640,894 | B1 * | 2/2014 | Cronin | A47B 97/00 108/183 |
| 2002/0036008 | A1 | 3/2002 | Hickam | |
| 2004/0129184 | A1 * | 7/2004 | Kraker | A45B 25/00 108/50.12 |

* cited by examiner

SECTION B-B

DETAIL C
SCALE 2 : 1

SHAFT MOUNTED CUP HOLDER ASSEMBLY

CROSS REFERENCE TO RELATED APPLICATIONS

This application is a 35 U.S.C. §371 U.S. national phase entry of International Application No. PCT/US2014/046371 having an international filing date of Jul. 11, 2014, which claims the benefit of U.S. Provisional Application No. 61/844,891 filed Nov. 7, 2013, each of which is incorporated herein by reference in its entirety.

TECHNICAL FIELD

The presently disclosed subject matter relates generally to cup holders and more particularly to shaft-mounted cup holders, hole-mounted cup holders, freestanding cup holders, and tabletop cup holders and methods.

BACKGROUND

Drinking cups that are placed on a surface, such as a tabletop, are prone to tipping and spilling. In particular, lightweight disposable cups, such as plastic cups, paper cups, and Styrofoam cups, are especially prone to tipping and spilling. For example, when used in a breezy outdoor environment or in any high activity environment, lightweight disposable cups are often tipped over and the contents spilled out. While some environments, such as in vehicles, provide cup holders, there are still many other environments (e.g., outdoor environments) in which there is little or no availability of surfaces on which to conveniently set a drinking cup and/or little or no means for securely holding the drinking cup.

SUMMARY

In some embodiments, a shaft mounted cup holder assembly is disclosed. The shaft mounted cup holder assembly may include one or more cup holder plates wherein each plate further includes one or more cut-outs configured for holding a drinking cup, and a central region comprising a center cut-out. The cup holder assembly may also include a central fastener that includes an upper coupler, a lower coupler, and a central cutout region. The one or more plates may be positioned between the upper coupler and the lower coupler, thereby aligning the center cut-out of the one or more plates and the central cut-out region of the fastener such that the cup holder assembly may receive a shaft therethrough.

In some embodiments, the one or more plates may be stacked and oriented substantially orthogonal to one another. The plates may also be substantially rectangular, substantially cross shaped, and/or substantially circular.

In some embodiments, the cup holder assembly may also include a shaft that extends through the cup holder assembly and the cup holder assembly may be optionally affixed thereto. The cup holder assembly may also include a base plate disposed beneath the cup holder plates, and further include a spacer between the cup holder plates and the base plate.

In some embodiments, the cup holder assembly may also include a base. The base may, in some embodiments, be weighted and configured to rest upon a surface, and in other embodiments may be configured to be installed in a surface such that the shaft and cup holder assembly may be removably installed therein.

The one or more plates and the fastener may also include snap features configured to enable the one or more plates to be optionally installed in, and subsequently removed from, the fastener. The plates may also include locking features configured to receive certiain cup holder accessories, including, for example, a hook, a bendable spline, and/or a pouch.

In certain other embodiments, the shaft mounted cup holder assembly may include one or more cup holder plates that include one or more cut-outs configured to hold a drinking cup, a central fastener that may include an upper coupler, a lower coupler, and a central cutout region. The one or more plates may be configured to couple to the fastener, and the central cut-out region may be configured to receive a shaft therethrough.

Certain other embodiments of the shaft mounted cup holder assembly may include one or more cup holder plates that include one or more cut-outs configured for holding a drinking cup, and a central region that includes a center cut-out, a central fastener that may include an upper coupler, a lower coupler, and a central cutout region, and a shaft configured for insertion in a hole in a surface. The one or more plates may be positioned between the upper coupler and the lower coupler, thereby aligning the center cut-out of the one or more plates and the central cut-out region of the fastener such that the cup holder assembly may receive the shaft therethrough and securely sit upon the surface.

The shaft mounted cup holder assembly may also include one or more cup holder plates that include one or more cut-outs configured for holding a drinking cup, and a central region comprising a center cut-out, a central fastener that may include an upper coupler, a lower coupler, and a central cutout region, a base, and a shaft configured for insertion in the base. In such embodiments, the one or more plates may be positioned between the upper coupler and the lower coupler, thereby aligning the center cut-out of the one or more plates and the central cut-out region of the fastener such that the cup holder assembly may receive the shaft therethrough and securely couple to the base.

BRIEF DESCRIPTION OF THE DRAWINGS

Figure 1:
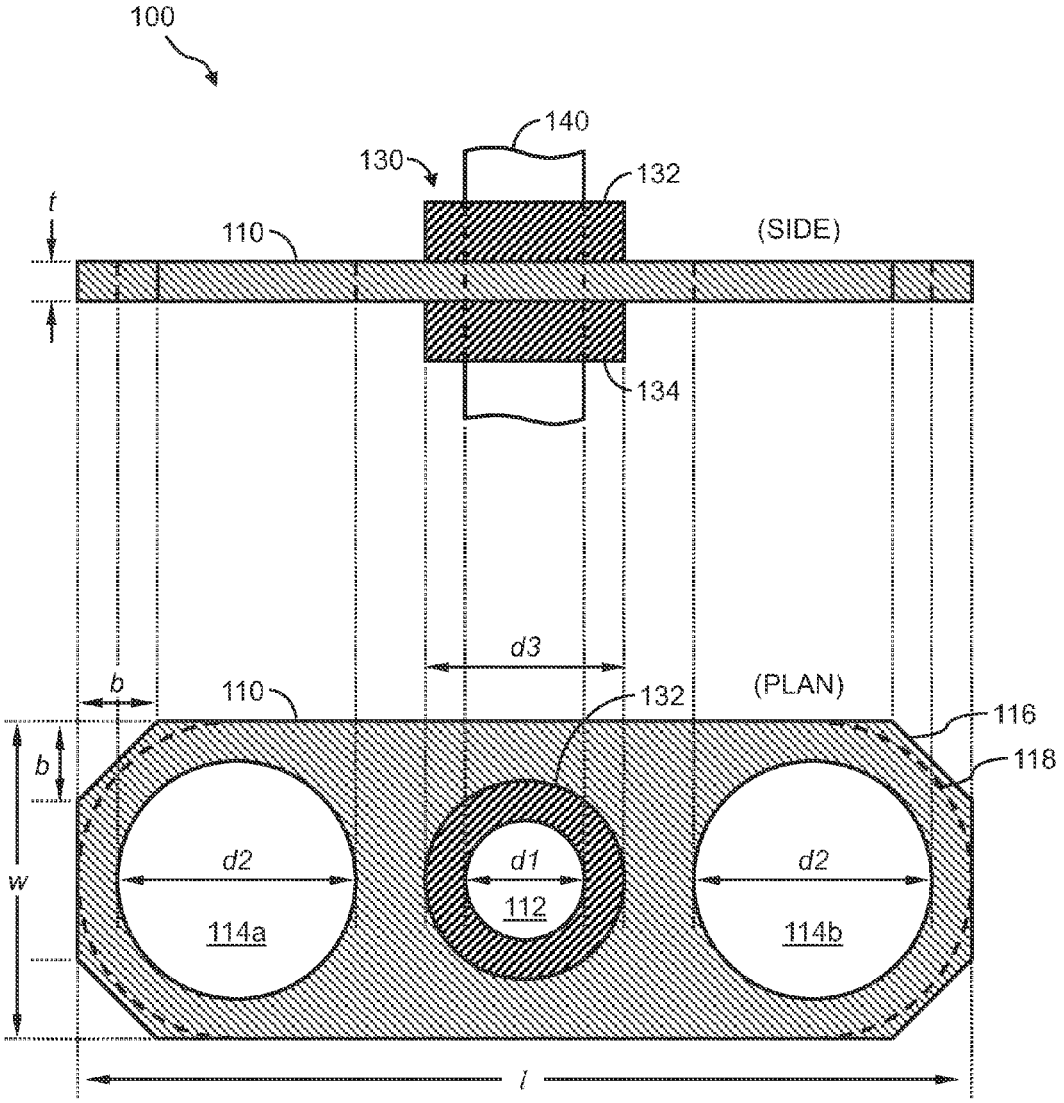
Figure 2:
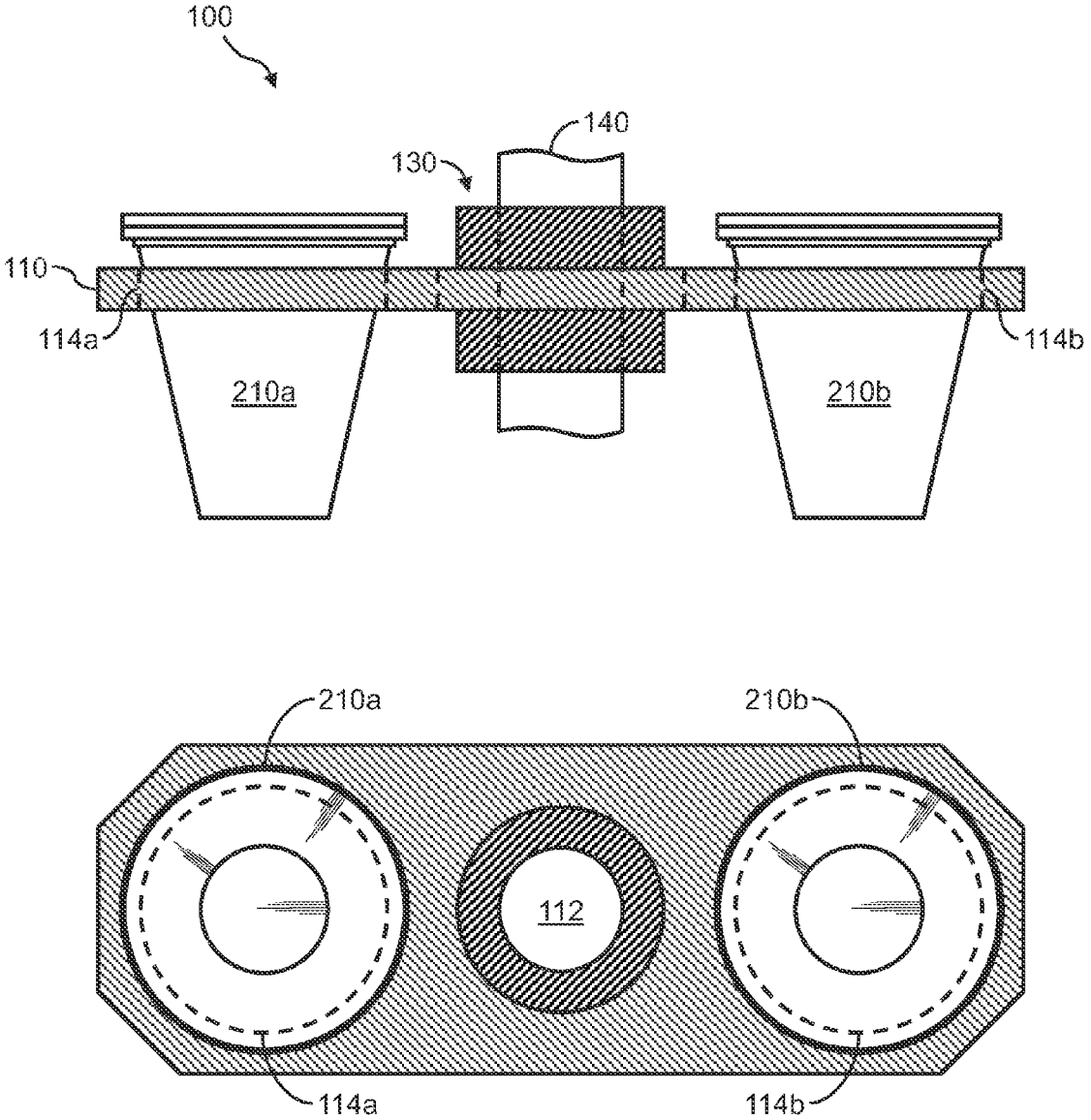
Figure 3:
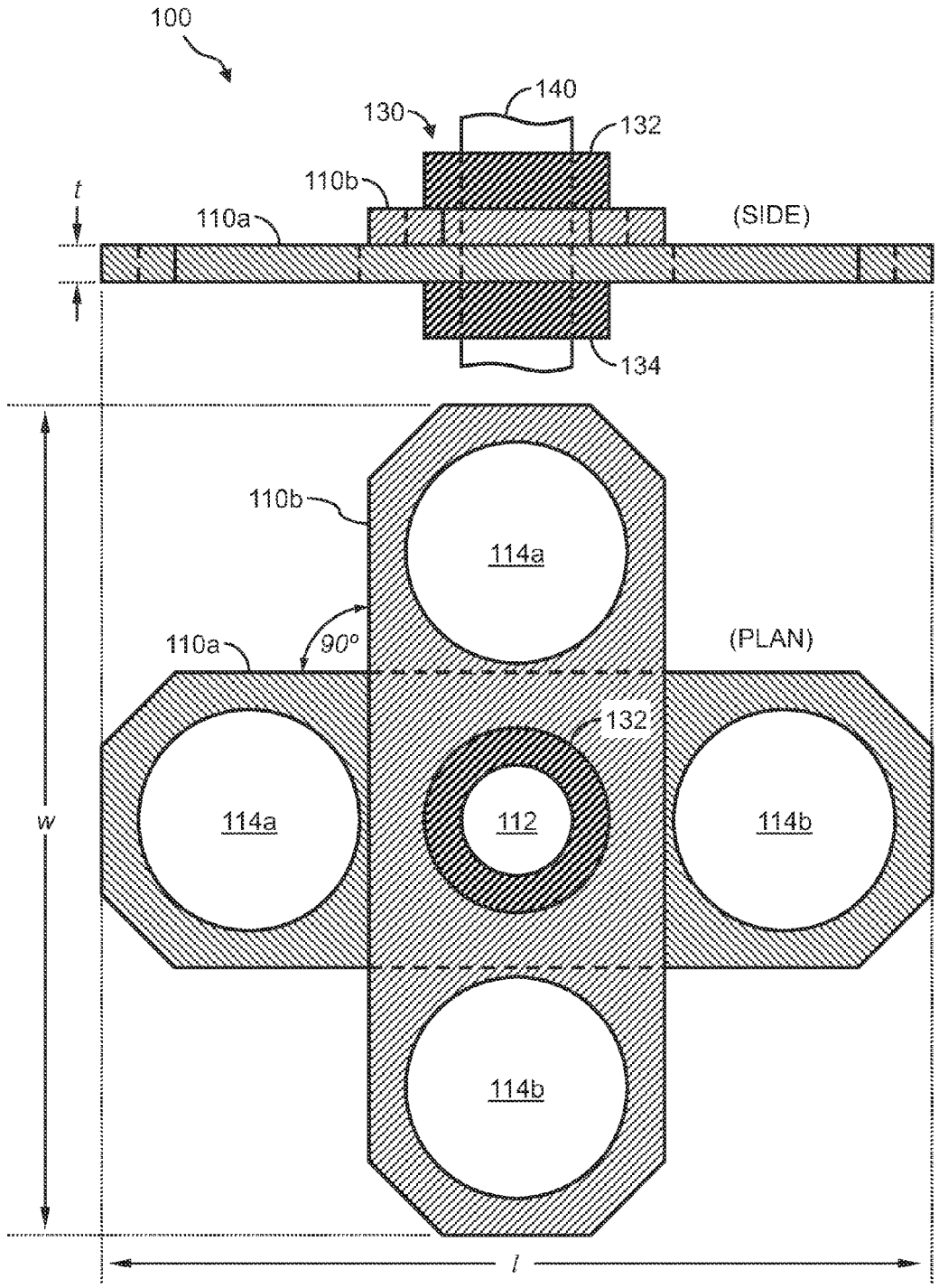
Figure 4:
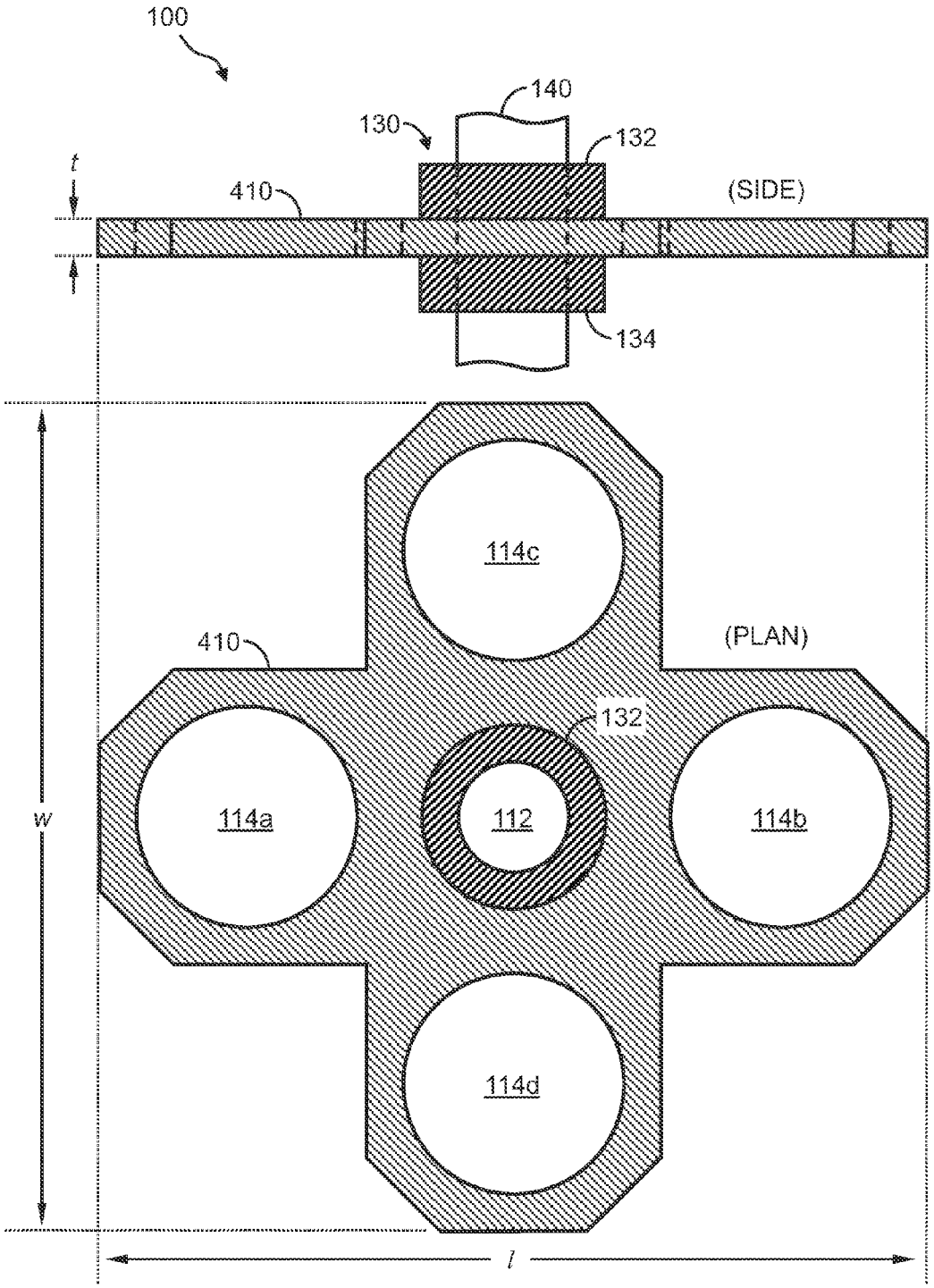
Figure 5:
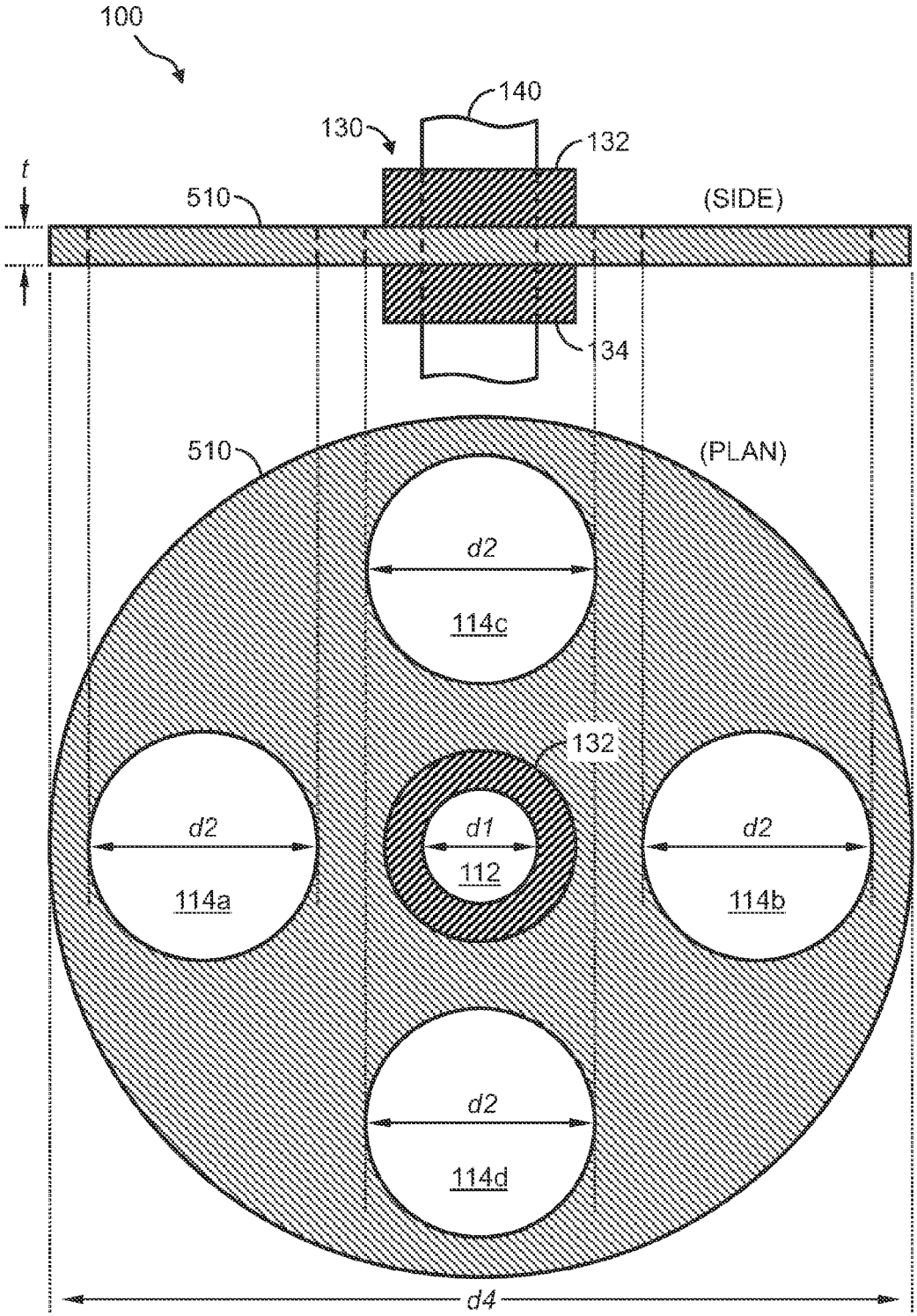
Figure 6:
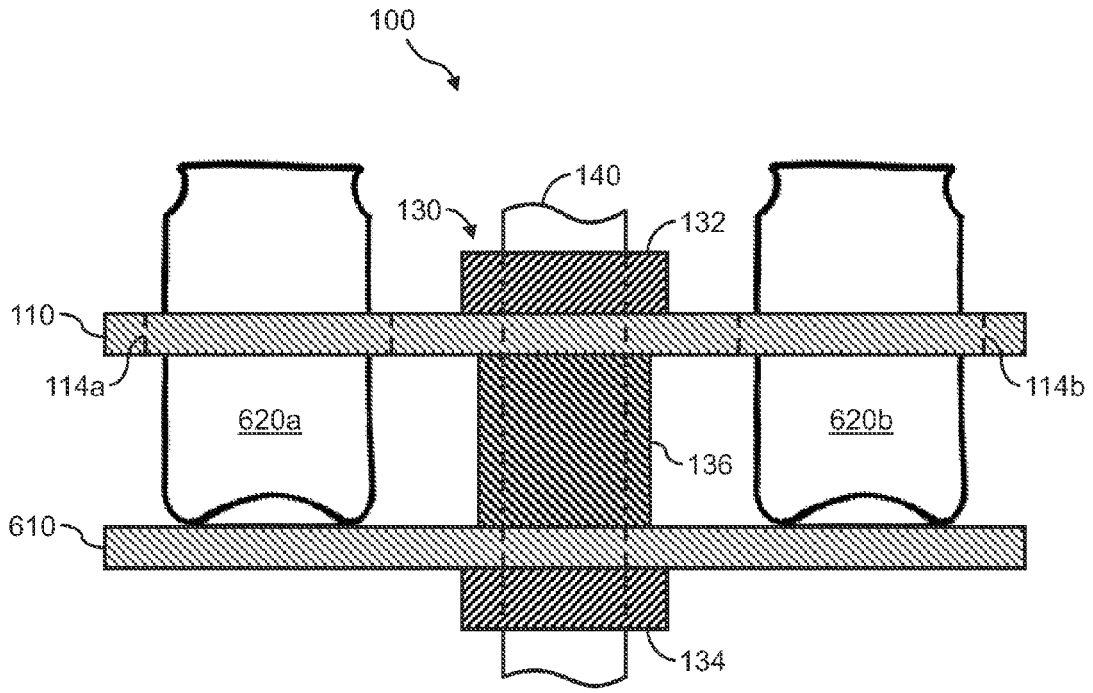
Figure 7:
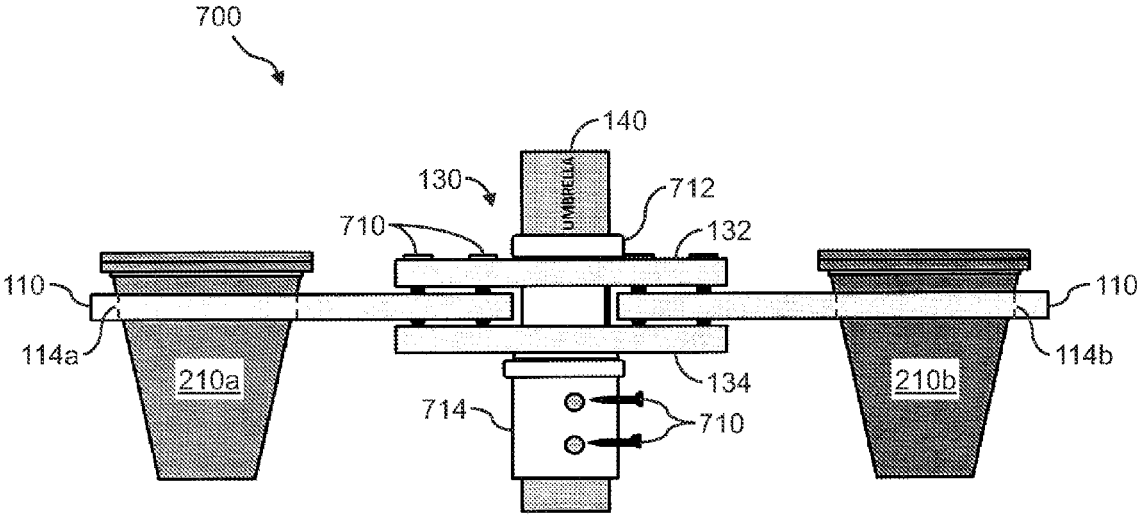
Figure 8:
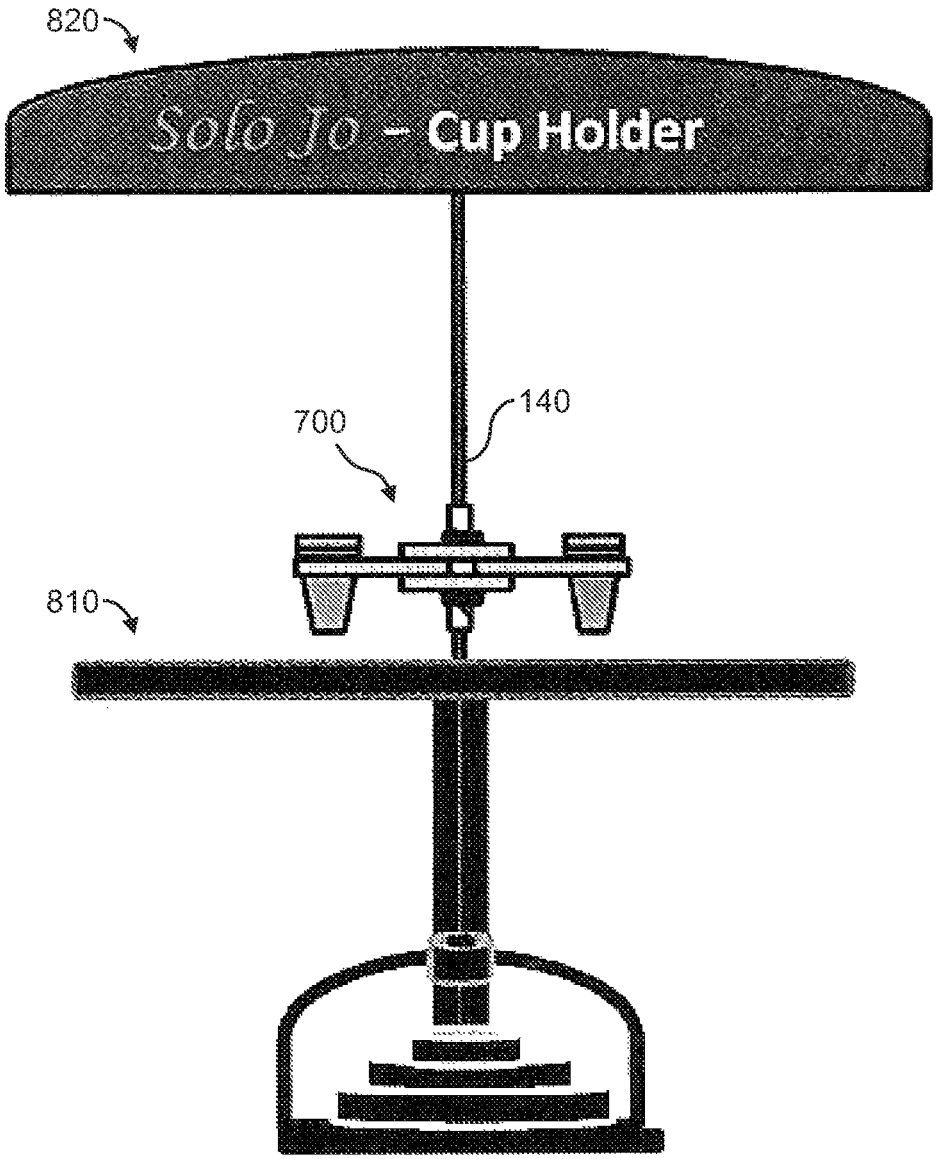
Figure 9:
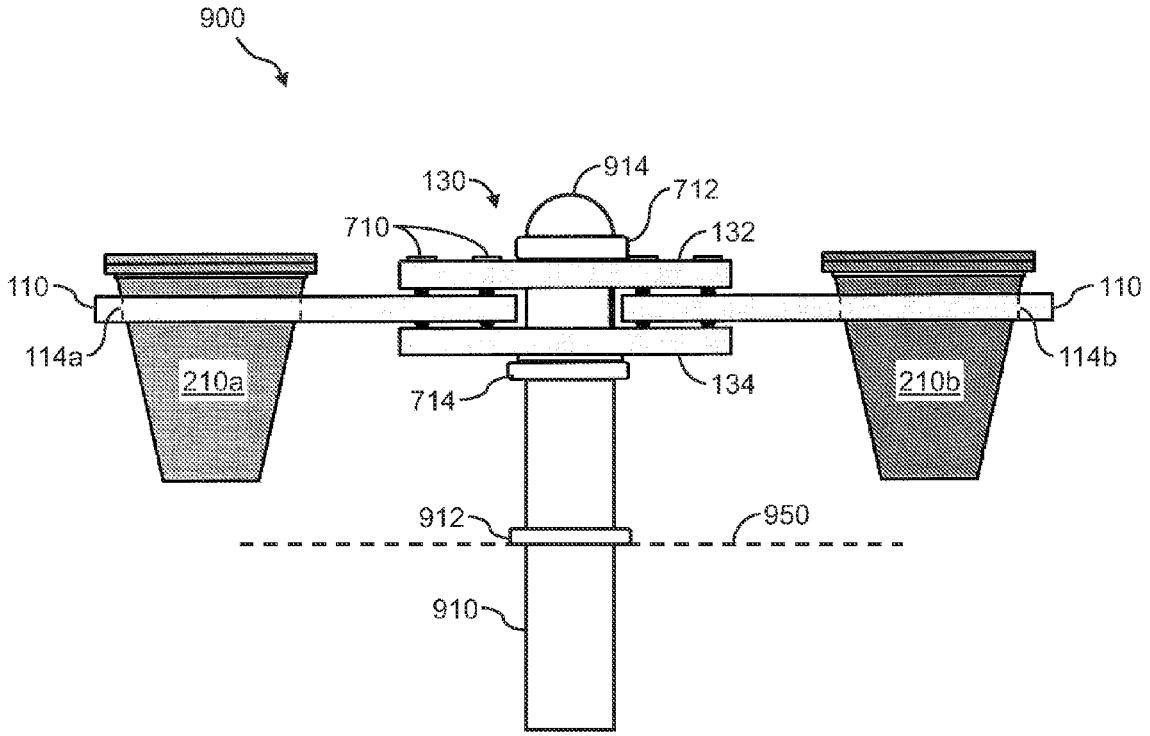
Figure 10:
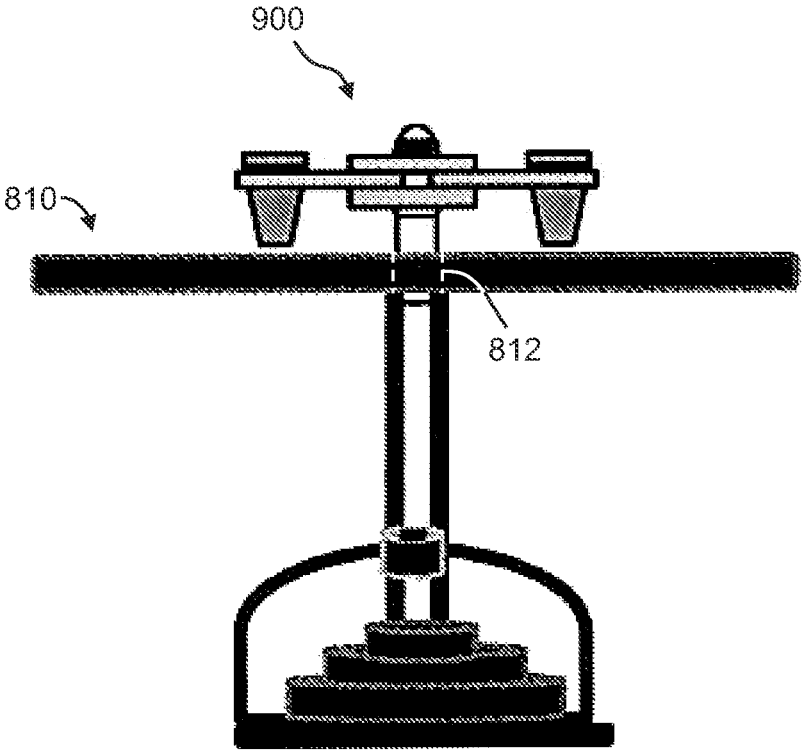
Figure 11:
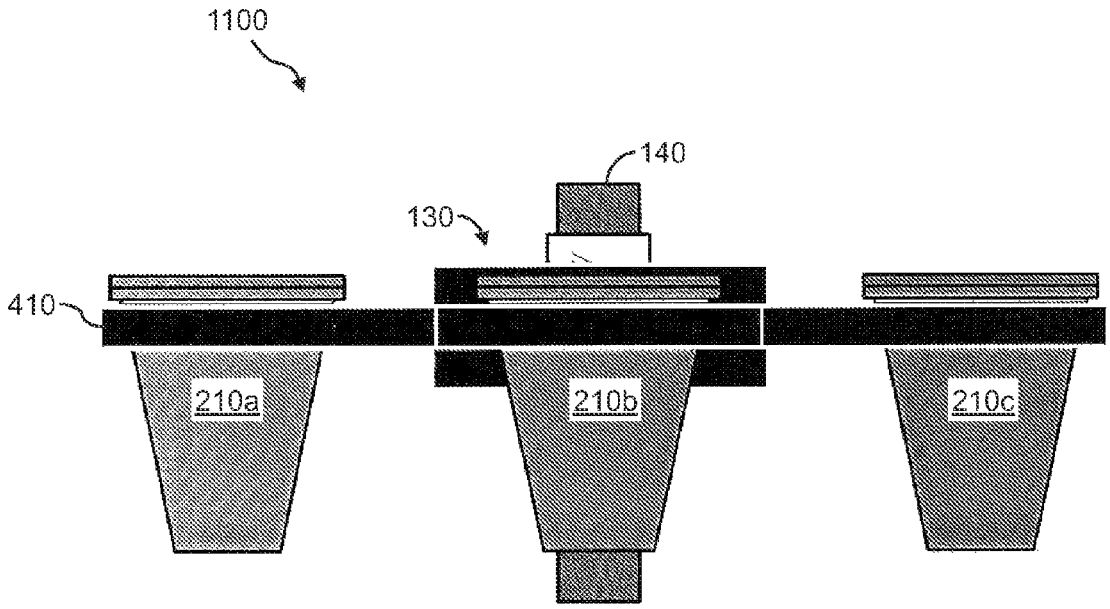
Figure 12:
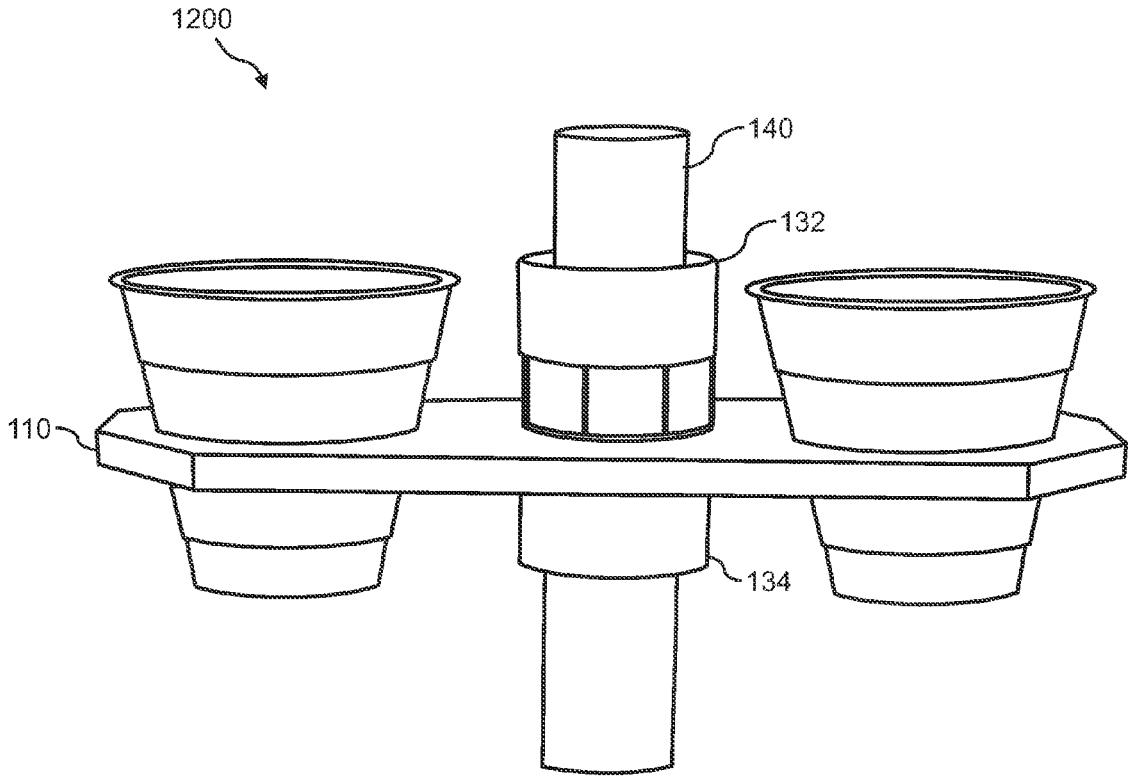
Figure 13:
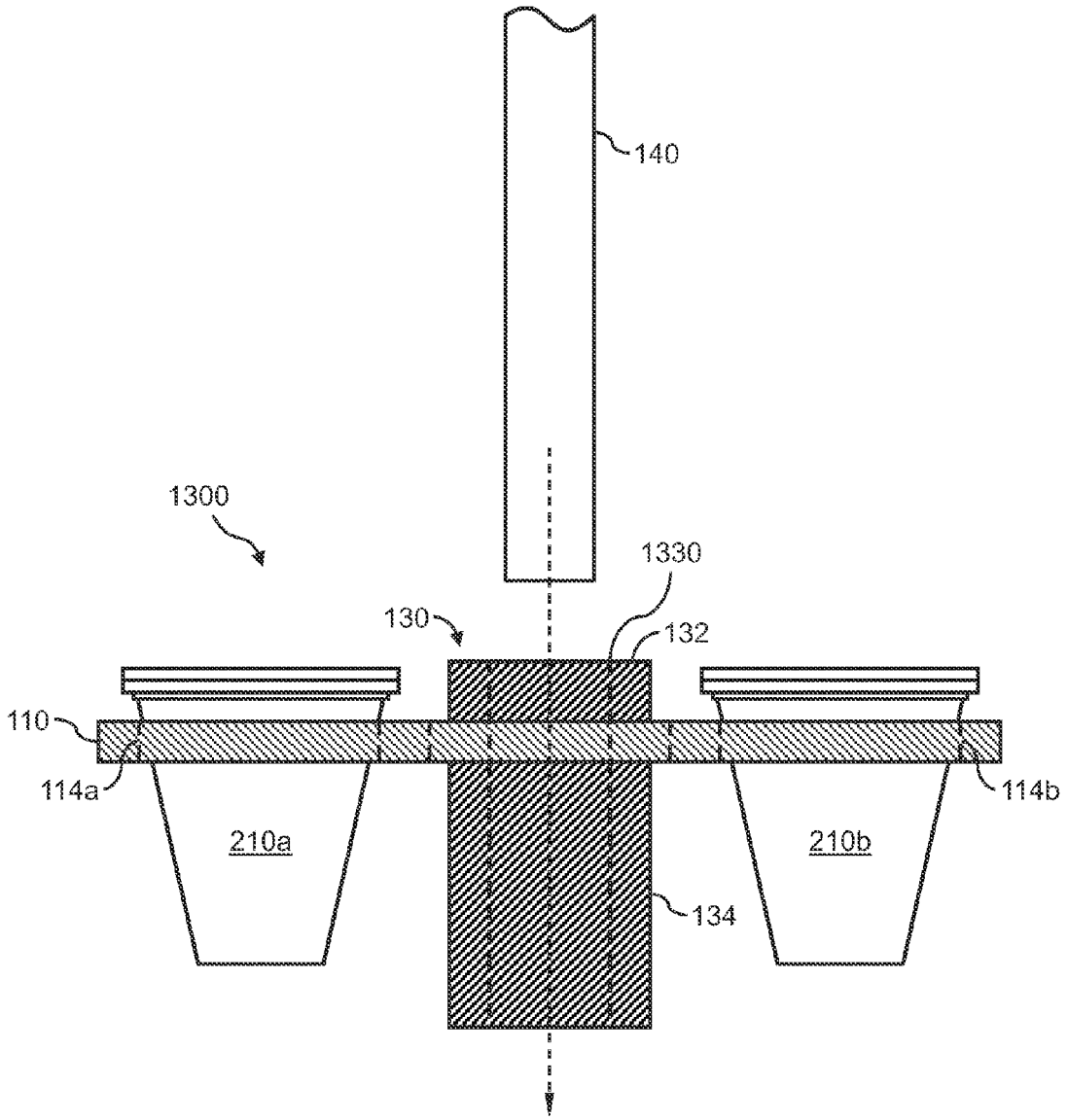
Figure 14:
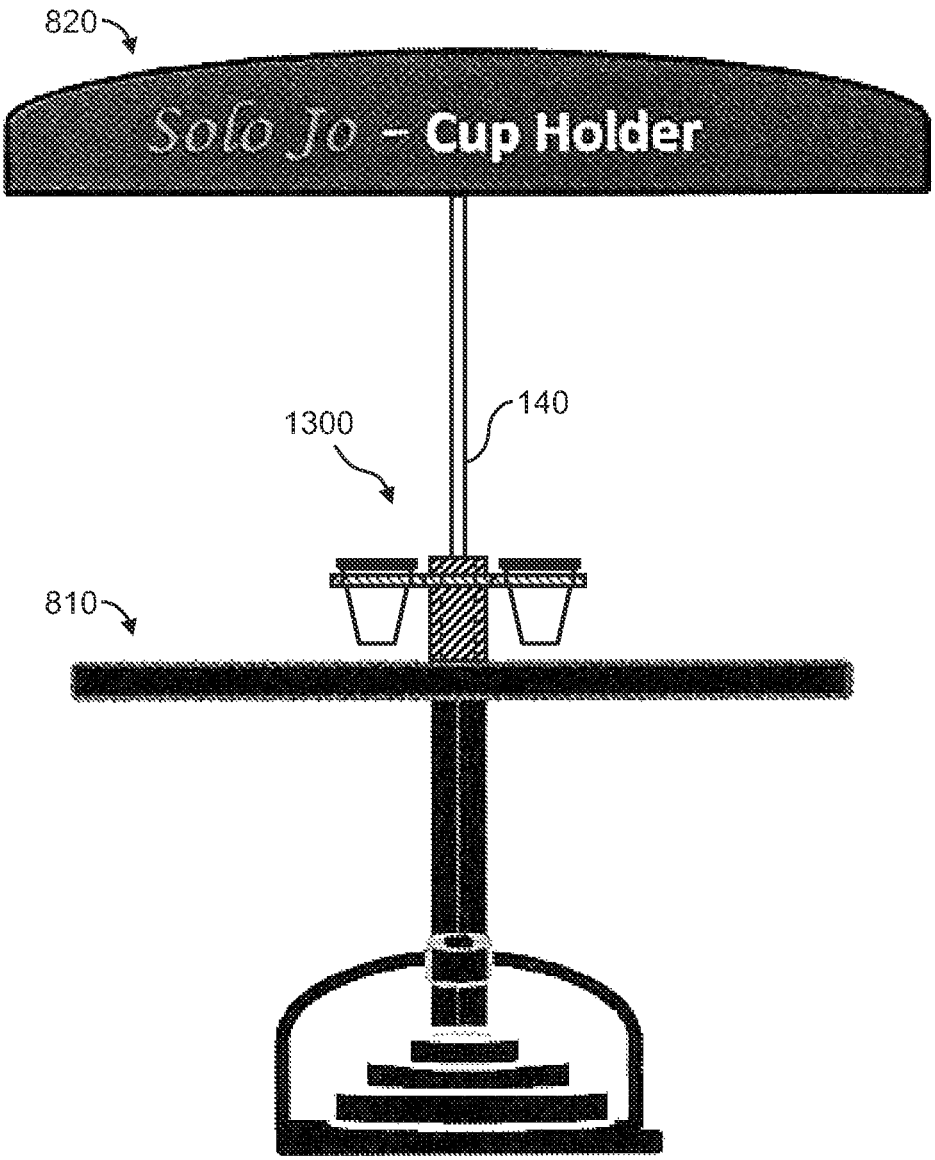
Figure 15:
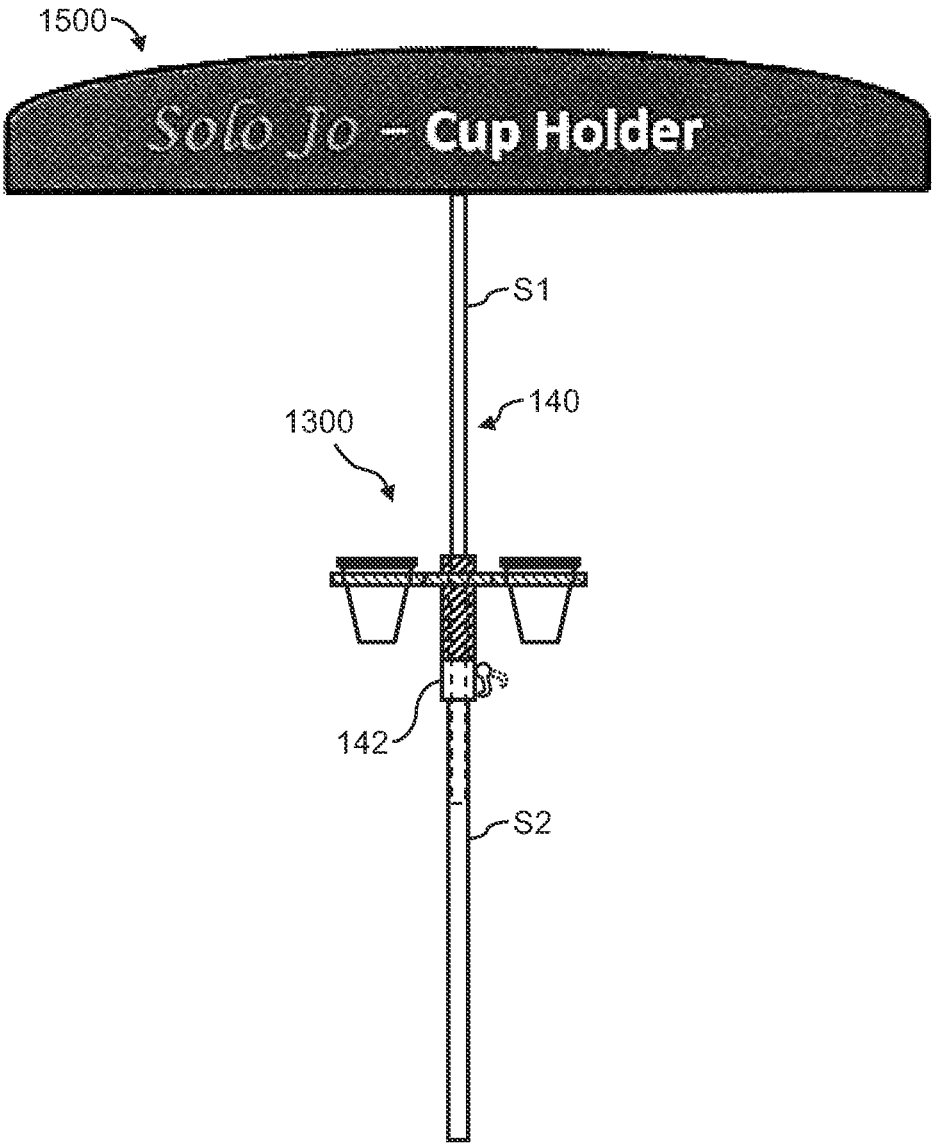
Figure 20:
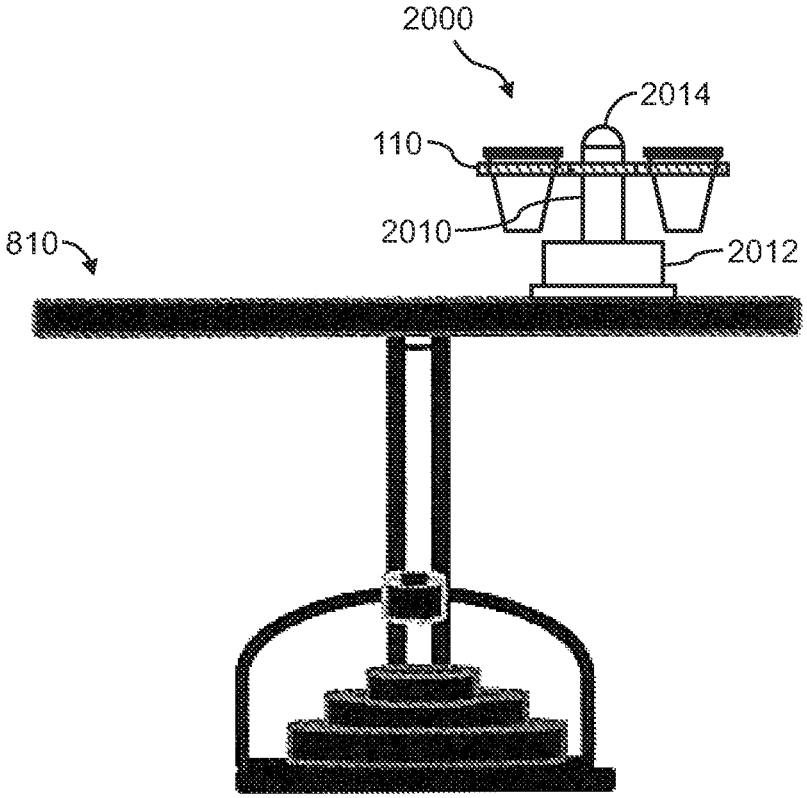
Figure 21:
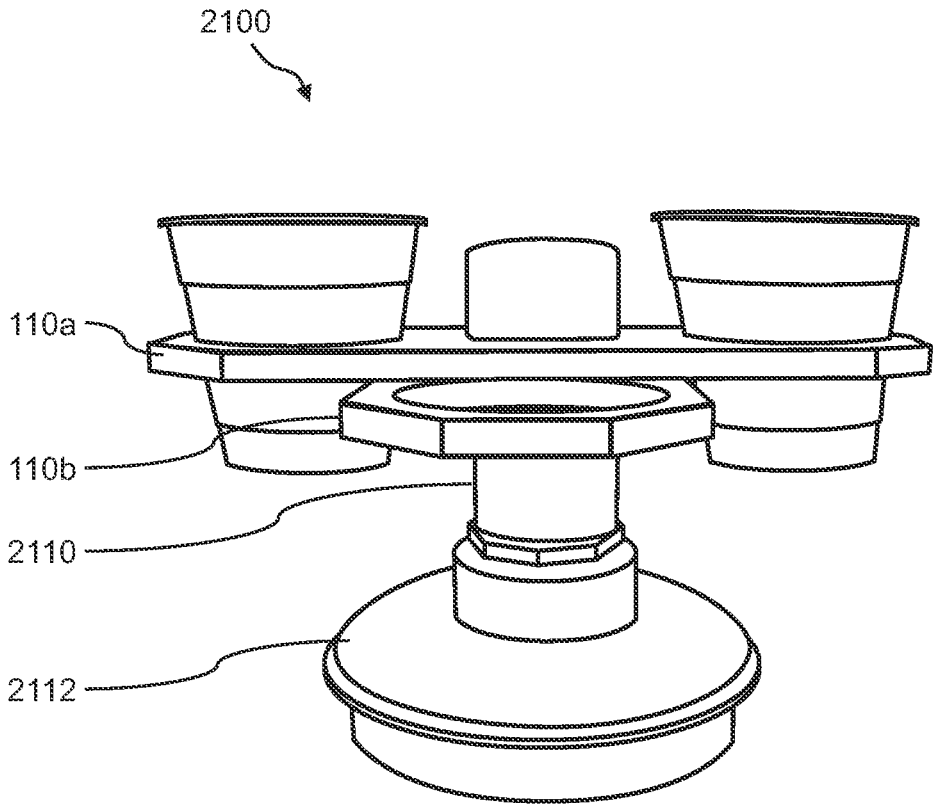
Figure 45:
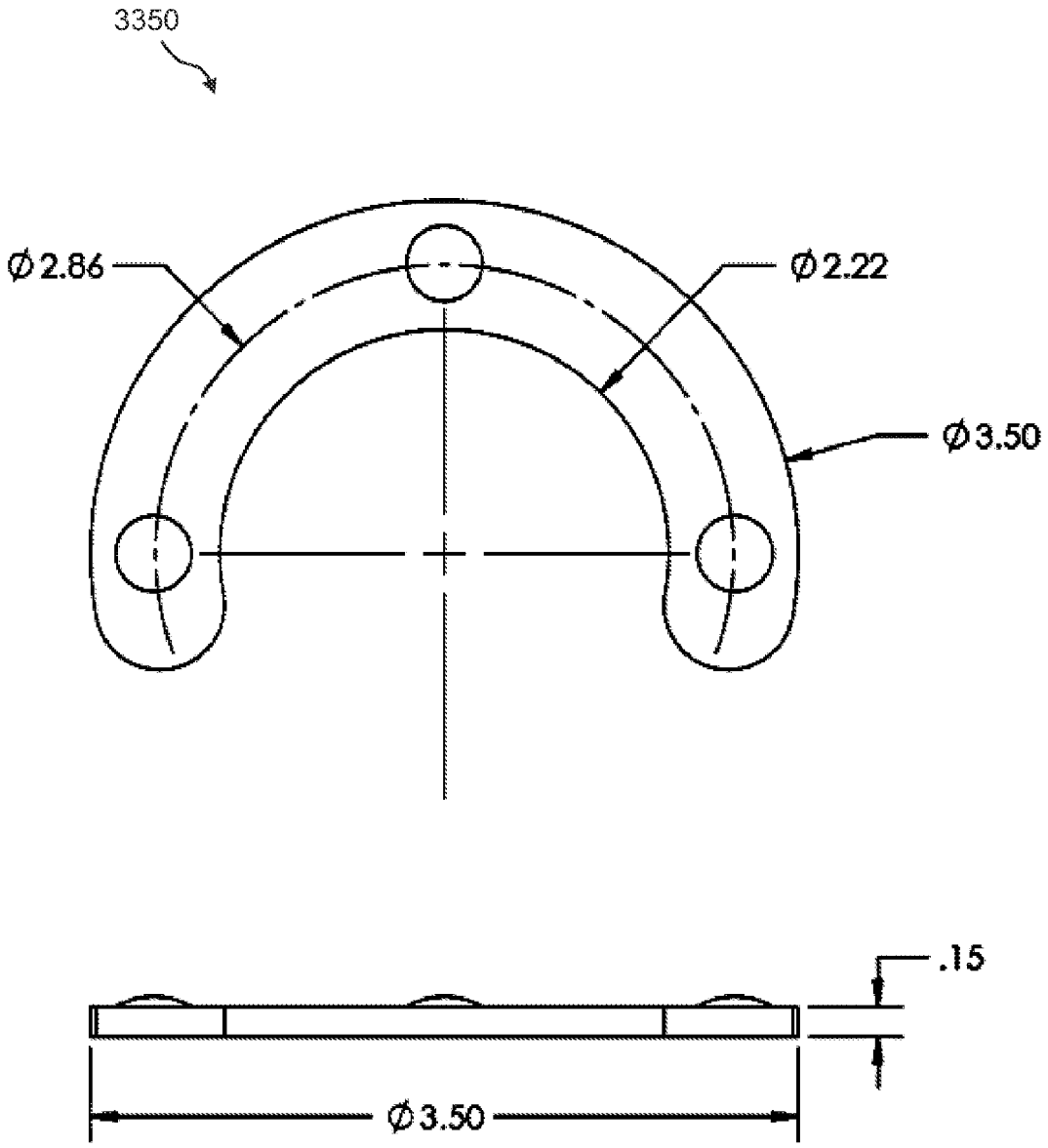
Figure 46:
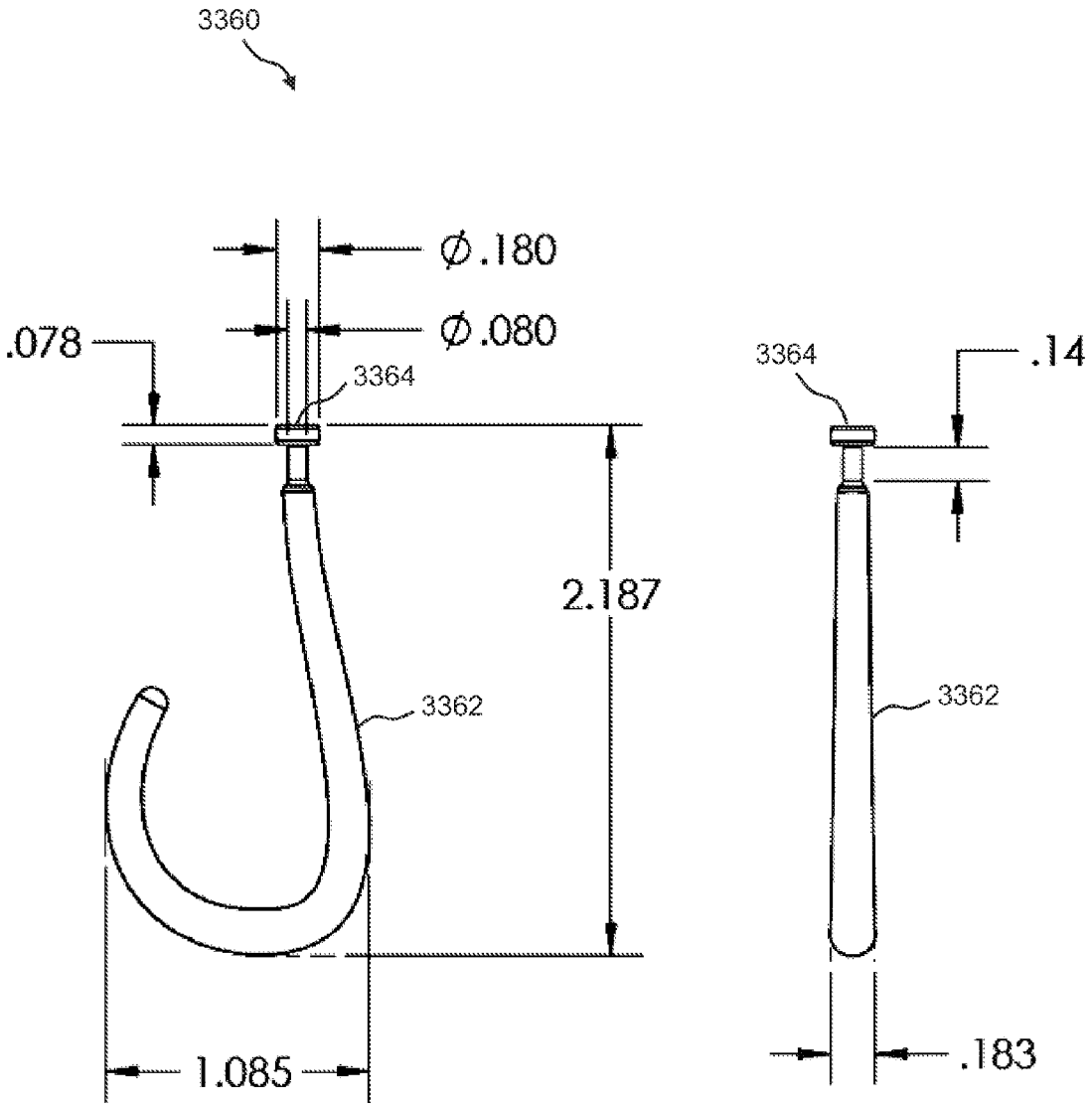
Figure 47:
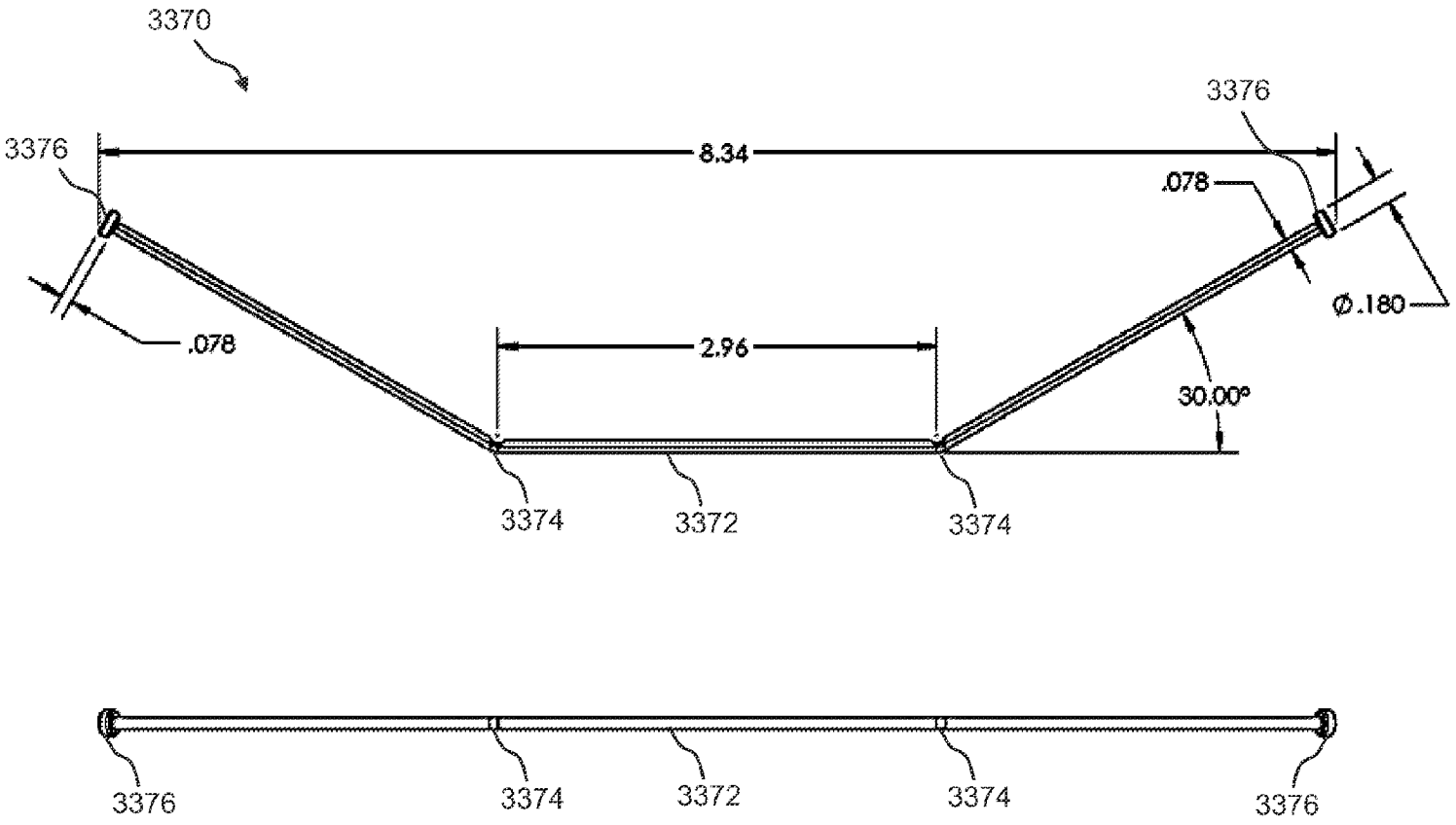
Figure 48:
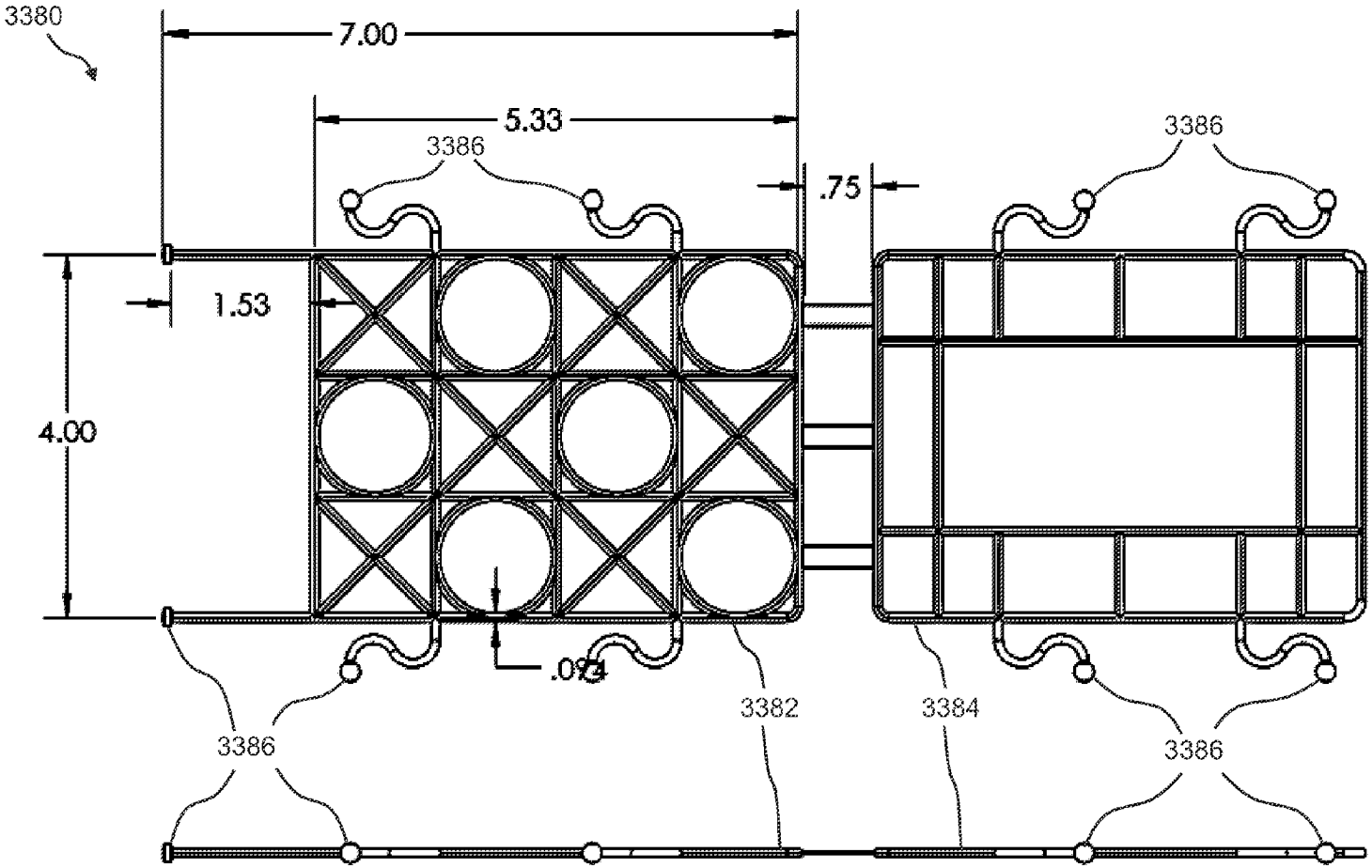

Having thus described the presently disclosed subject matter in general terms, reference will now be made to the accompanying Drawings, which are not necessarily drawn to scale, and wherein:

FIG. 1 illustrates a side view and a plan view of an example cup holder assembly that includes a 2-cup plate to form a 2-cup holder;

FIG. 2 illustrates a side view and a plan view of the presently disclosed cup holder assembly of FIG. 1 when in use;

FIG. 3 illustrates a side view and a plan view of an example cup holder assembly that includes two 2-cup plates to form a 4-cup holder;

FIG. 4 illustrates a side view and a plan view of an example cup holder assembly that includes a first example of a 4-cup plate to form a 4-cup holder;

FIG. 5 illustrates a side view and a plan view of an example cup holder assembly that includes a second example of a 4-cup plate to form a 4-cup holder;

FIG. 6 illustrates a side view of an example cup holder assembly that includes a base plate in addition to, for example, the 2-cup plate;

FIG. 7 illustrates a side view of an example of a shaft-mounted cup holder that is based on the cup holder assembly shown in FIG. 1;

FIG. 8 illustrates a side view of a table that has a table umbrella, wherein the shaft-mounted 2-cup holder of FIG. 7 is installed on the shaft thereof;

FIG. 9 illustrates a side view of an example of a hole-mounted cup holder that is based on the cup holder assembly shown in FIG. 1;

FIG. 10 illustrates a side view of an example of the hole-mounted 2-cup holder of FIG. 9 when in use;

FIG. 11 illustrates a side view of another example of a shaft-mounted cup holder that is based on the cup holder assembly shown in FIG. 4;

FIG. 12 illustrates a side view of yet another example of a shaft-mounted cup holder that is based on the cup holder assembly shown in FIG. 1;

FIG. 13 illustrates a side view of an example of a loosely fitted shaft-mounted 2-cup holder that is based on the cup holder assembly shown in FIG. 1;

FIG. 14 and FIG. 15 illustrate examples of the shaft-mounted 2-cup holder of FIG. 13 when in use;

FIG. 16, FIG. 17, FIG. 18, and FIG. 19 illustrate various views of examples of freestanding cup holders;

FIG. 20 and FIG. 21 illustrate various views of examples of tabletop cup holders, FIG. 22 through FIG. 32 illustrate various views of a 2-plate cup holder system that can be sized and configured in various ways;

FIG. 33 through FIG. 45 illustrate various views of an umbrella-mounted cup holder system; and FIG. 46, FIG. 47, and FIG. 48 illustrate various views of examples of accessories that can be used with the umbrella-mounted cup holder system of FIG. 33 through FIG. 45.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides shaft-mounted cup holders, hole-mounted cup holders, freestanding cup holders, and tabletop cup holders and methods. For example, the shaft-mounted cup holders are cup holders that can be affixed to, for example, the shaft or pole of a table umbrella, patio umbrella, or beach umbrella. The hole-mounted cup holders are cup holders that are mounted in the hole of a table. For example, the hole in a patio table that is designed to hold a table umbrella can be used for mounting the hole-mounted cup holders instead of for holding the table umbrella. The freestanding cup holders are cup holders that can stand independently on the ground. The tabletop cup holders are cup holders that can stand independently on a surface.

The shaft-mounted cup holders and hole-mounted cup holders provide a convenient means of affixing a cup holder to an existing piece of furniture, such as a patio table, picnic table, or freestanding umbrella. The freestanding cup holders and tabletop cup holders provide a convenient means of securely holding drinking cups in environments that otherwise have no means of holding drinking cups, such as at the beach or in a backyard.

Referring now to FIG. 1, a side view and a plan view of an example cup holder assembly 100 that includes a 2-cup plate to form a 2-cup holder is presented. For example, the cup holder assembly 100 includes a 2-cup plate 110 and a center fastener 130. The 2-cup plate 110 and the center fastener 130 are designed to be slidably or permanently affixed to a shaft or pole 140. For example, the shaft or pole 140 can be the shaft or pole of a table umbrella, patio umbrella, or beach umbrella, or any shaft or pole for supporting the cup holder assembly 100.

The 2-cup plate 110 is typically an elongated plate that includes a center hole 112 and two cup holes 114 (e.g., cup holes 114*a* and 114*b*). The 2-cup plate 110 has a length l, a width w, and a thickness t. The length l of the 2-cup plate 110 can typically be from about 10 inches to about 12 inches in one example, or can be about 11.25 inches in another example. The width w of the 2-cup plate 110 can typically be from about 3.5 inches to about 4.5 inches in one example, or can be about 4 inches in another example. The thickness t of the 2-cup plate 110 can typically be from about 0.25 inches to about 0.5 inches in one example, or can be about 0.375 inches in another example. In certain other embodiments, the length l, width w, and thickness t may be any other appropriate dimension. The 2-cup plate 110 can be formed of any lightweight rigid material, such as, but not limited to, wood, wood composite, fiberglass, plastic (e.g., PVC or molded plastic), aluminum, or any combinations thereof.

The center hole 112 has a diameter d1. The diameter d1 can vary depending on the diameter of shaft or pole 140. The diameter d1 of the center hole 112 can typically be from about 1 inch to about 2.5 inches in one example, or can be about 2 inches in another example, or can be about 1.75 inches in yet another example, or can be about 1.5 inches in still another example. The cup holes 114 have a diameter d2. The diameter d2 can vary depending on the diameter of the cups to be used with the cup holder assembly 100. The diameter d2 of the cup holes 114 can typically be from about 2.5 inches to about 3.5 inches in one example, or can be about 3 inches in another example. In the example of diameter d2=3 inches, the centers of the cup holes 114 may be located about 3.5 inches from the ends of the 2-cup plate 110.

In one example, the 2-cup plate 110 may have beveled ends 116, wherein the corners are cut a distance b from the corners of the 2-cup plate 110. In one example, the distance b is about 1 inch. In another example, the 2-cup plate 110 has rounded ends 118. In yet another example, when diameter d2 of the cup holes 114 is 3 inches (i.e., radius=1.5 inches), then the radius of the rounded ends 118 is 2 inches. The cup holes 114 and the rounded ends 118 are formed around the same center point. In yet another example, the ends of the 2-cup plate 110 may be left squared off (not shown).

The center fastener 130 can be any mechanism for holding the 2-cup plate 110 and for securing the 2-cup plate 110 to the shaft or pole 140. The center fastener 130 has a diameter d3. The diameter d3 can vary depending on the diameter of shaft or pole 140. The diameter d3 of the center fastener 130 can typically be from about 2 inches to about 3 inches in one example, or can be about 2.5 inches in another example.

The center fastener 130 can include any arrangement of couplers, fasteners, fittings, and/or spacers. In one example, the center fastener 130 may include an upper coupler 132 and a lower coupler 134, wherein the 2-cup plate 110 may be sandwiched therebetween. In another example, the upper coupler 132 and the lower coupler 134 can be standard PVC couplers or fittings (threaded or adhered). The components of the center fastener 130 can be affixed to the 2-cup plate 110 using various methods depending on the materials and components forming the center fastener 130 and the 2-cup plate 110. Example methods include, but are not limited to, screws; nails; adhesives; welding; threaded couplers, fasteners, and/or fittings; press-fitted couplers, fasteners, and/or fittings; or any combinations thereof.

Referring now to FIG. 2, a side view and a plan view of the presently disclosed cup holder assembly 100 of FIG. 1 when in use is presented. For example, FIG. 2 shows a cup 210*a* held in cup hole 114*a* and a cup 210*b* held in cup hole 114*b*. In this example, the sides of the cups 210 are tapered as shown. Namely, the diameter of the top of the cups 210 is larger than diameter d2 of cup holes 114, while the diameter of the bottom of the cups 210 is smaller than diameter d2 of cup holes 114. As a result, the cups 210 can rest in the cup holes 114 without falling through. The cups 210 can be, for example, any 8-ounce cups, 12-ounce cups, 16-ounce cups, or 20-ounce cups. The cups may also be any other size desired.

Other variations of the cup holder assembly 100 are described hereinbelow with reference to FIG. 3, FIG. 4, FIG. 5, and FIG. 6.

Referring now to FIG. 3, a side view and a plan view of an example of the cup holder assembly 100 that includes two 2-cup plates 110 to form a 4-cup holder is presented. In this example, the two 2-cup plates 110 (e.g., 2-cup plates 110*a* and 110*b*) are arranged in a stack, wherein the 2-cup plates 110*a* and 110*b* are sandwiched between the upper coupler 132 and the lower coupler 134 of the center fastener 130. Further, in this example, the 2-cup plates 110*a* and 110*b* are oriented at about 90 degrees to each other (in cross fashion) about their respective center holes 112. In this configuration, the cup holder assembly 100 provides the cup hole 114*a* and the cup hole 114*b* in 2-cup plate 110*a* as well as the cup hole 114*a* and the cup hole 114*b* in 2-cup plate 110*b*, thereby providing a total of four cup holes 114.

Referring now to FIG. 4, a side view and a plan view of an example of the cup holder assembly 100 that includes a first example of a 4-cup plate to form a 4-cup holder is presented. In this example, the cup holder assembly 100 includes a single 4-cup plate 410, which is cross-shaped, instead of the two stacked 2-cup plates 110 (i.e., the 2-cup plates 110*a* and 110*b*) shown in FIG. 3. The 4-cup plate 410 provides substantially the same cross configuration that is shown in FIG. 3, albeit with one plate instead of two. Accordingly, the 4-cup plate 410 includes four cup holes 114 (e.g., cup holes 114*a*, 114*b*, 114*c*, and 114*d*).

The 4-cup plate 410 has substantially the same features and dimensions as the 2-cup plate 110 of FIG. 1 except that the length l and width w are about the same. For example, both the length l and width w of the 4-cup plate 410 can typically be from about 10 inches to about 12 inches in one example, or can be about 11.25 inches in another example. In this example, the 4-cup plate 410 is optionally sandwiched between the upper coupler 132 and the lower coupler 134 of the center fastener 130.

Referring now to FIG. 5, a side view and a plan view of an example of cup holder assembly 100 that includes a second example of a 4-cup plate to form a 4-cup holder is presented. In this example, the cup holder assembly 100 includes a 4-cup plate 510, which is circular, instead of the cross-shaped 4-cup plate 410 shown in, for example, FIG. 4. Accordingly, the 4-cup plate 510 also includes the four cup holes 114 (e.g., cup holes 114*a*, 114*b*, 114*c*, and 114*d*).

The 4-cup plate 510 typically has substantially the same features and dimensions as the 2-cup plate 110 of FIG. 1 and the 4-cup plate 410 of FIG. 4 except that 4-cup plate 510 is circular and has a diameter d4. The diameter d4 of the 4-cup plate 510 can typically be from about 9.5 inches to about 12 inches in one example, or can be about 11.25 inches in another example, or about 18 inches to about 24 inches in another example. In this example, the 4-cup plate 510 is optionally sandwiched between the upper coupler 132 and the lower coupler 134 of the center fastener 130.

Not all beverage containers (e.g., cups 210 shown in FIG. 2) are tapered. For example, beverage cans and bottles may not be tapered. Without the taper, beverage cans and bottles may fall through the cup holes 114 of the cup holder assembly 100. Therefore, the cup holder assembly 100 can optionally include a base plate in addition to, for example, the 2-cup plate 110, the 4-cup plate 410, or the 4-cup plate 510.

Referring now to FIG. 6, a side view of an example of the cup holder assembly 100 that includes a base plate 610 in addition to, for example, the 2-cup plate 110 is presented. In this example, the shape and features of the base plate 610 is substantially the same as those of the 2-cup plate 110 except that the base plate 610 does not include the cup holes 114. That is, the base plate 610 is a solid plate. Further, the center fastener 130 typically includes a spacer 136 between the 2-cup plate 110 and the base plate 610.

By way of example, FIG. 6 shows a beverage can 620*a* in the cup hole 114*a* and a beverage can 620*b* in the cup hole 114*b*, wherein the beverage cans 620*a* and 620*b* are sitting atop the base plate 610. In another example, when the cup holder assembly 100 includes the 4-cup plate 410 of FIG. 4, then the shape and features of the base plate 610 is substantially the same as those of the 4-cup plate 410, absent the cup holes 114. In yet another example, when the cup holder assembly 100 includes the 4-cup plate 510 of FIG. 5, then the shape and features of the base plate 610 is substantially the same as those of the 4-cup plate 510, absent the cup holes 114.

Referring again to FIG. 1 through FIG. 6, the presently disclosed cup holder assembly 100 is not limited to two or to four of the cup holes 114. The cup holder assembly 100 may include any number of cup holes 114 arranged substantially radially about the center hole 112 to the extent that there is sufficient installation space available. Accordingly, the cup holder assembly 100 can include a 1- to n-cup plate, n being any number of cup holes 114 arranged substantially radially about the center hole 112. Additionally, regardless of the types of materials used to form the presently disclosed cup holder assembly 100, the cup holder assembly 100 can be any color or combinations of colors.

The presently disclosed shaft-mounted cup holders, hole-mounted cup holders, freestanding cup holders, and tabletop cup holders are based on the cup holder assembly 100 and the variations thereof that are described with reference to FIG. 1 through FIG. 6. Accordingly, the exact components of the center fastener 130, such as upper coupler 132, lower coupler 134, and spacer 136 can vary depending on the type of cup holder. For example, the center fastener 130 of a shaft-mounted cup holder can include certain components, while the center fastener 130 of a hole-mounted cup holder can include other components, while the center fastener 130 of a freestanding cup holder can include yet other components, and while the center fastener 130 of a tabletop cup holder can include still other components. Examples of shaft-mounted cup holders, hole-mounted cup holders, freestanding cup holders, and tabletop cup holders that are based on the cup holder assembly 100 are shown and described below in FIG. 7 through FIG. 21.

Referring now to FIG. 7, a side view of an example of a shaft-mounted cup holder that is based on the cup holder assembly 100 shown in FIG. 1 is presented. Namely, FIG. 7 shows a shaft-mounted 2-cup holder 700 that is formed of, for example, wood. In this example, the 2-cup plate 110 is segmented into two separate pieces of wood that are fastened via a set of screws 710 between and to the upper coupler 132 and lower coupler 134, which are also formed of, for example, wood. In this example, the center fastener 130 also includes other couplers, such as couplers 712 and 714, between which the wooden upper coupler 132 and wooden lower coupler 134 are supported. The couplers 712 and 714 may be, for example, plastic couplers that may be permanently affixed to the shaft or pole 140 via yet other screws 710. In this example, the shaft or pole 140 may be the shaft or pole of a freestanding beach or patio umbrella or of a table umbrella. For example, FIG. 8 shows a table 810 that has a table umbrella 820, wherein the shaft-mounted 2-cup holder 700 of FIG. 7 is installed on the shaft or pole 140 of the table umbrella 820. The examples discussed with reference to FIG. 7 and FIG. 8 may also be formed from any other material desired, in addition to wood.

Referring now to FIG. 9, a side view of an example of a hole-mounted cup holder that is based on the cup holder assembly 100 shown in FIG. 1 is presented. Namely, FIG. 9 shows a hole-mounted 2-cup holder 900 that is formed of wood (as an example). The hole-mounted 2-cup holder 900 is substantially the same as the shaft-mounted 2-cup holder 700 of FIG. 7 except that it has been modified to be hole-mounted instead of shaft-mounted. That is, in the hole-mounted 2-cup holder 900, a shaft 910, such as a hollow plastic pipe, extends downward from the coupler 714. The shaft 910 may be sized to fit in the hole of a table that normally is used to receive, for example, a table umbrella. A stop ring 912 may be provided along the length of the shaft 910 in order to set the height of the 2-cup plate 110 off of the tabletop surface (e.g., surface 950). A decorative cap 914 may be provided atop the coupler 712, if desired. FIG. 10 shows the table 810, wherein the shaft 910 of the hole-mounted 2-cup holder 900 of FIG. 9 is installed in the hole (e.g., a hole 812) of the table 810 that normally is used to receive a table umbrella, such as the table umbrella 820 of FIG. 8. Once again, the examples discussed with reference to FIG. 9 and FIG. 10 may also be formed from any other material, or combination of materials, desired, in addition to wood.

Referring now to FIG. 11, a side view of another example of a shaft-mounted cup holder that is based on the cup holder assembly 100 shown in FIG. 4 is presented. Namely, FIG. 11 shows a shaft-mounted 4-cup holder 1100, wherein the 4-cup plate 410 is formed from a sheet of PVC (as an example). In this example, the shaft-mounted 4-cup holder 1100 may be permanently affixed to the shaft or pole 140. Additionally, a hole-mounted version, similar to the hole-mounted 2-cup holder 900 of FIG. 9, can be formed using the PVC 4-cup plate 410. Other materials discussed herein may also be used to form 2-cup holder 900 of FIG. 9.

Referring now to FIG. 12, a side view of yet another example of a shaft-mounted cup holder that is based on the cup holder assembly 100 shown in FIG. 1 is presented. Namely, FIG. 12 shows a shaft-mounted 2-cup holder 1200, wherein the 2-cup plate 110 is formed from a sheet of PVC (as an example). In this example, the shaft-mounted 2-cup holder 1200 may be permanently affixed to the shaft or pole 140 through upper coupler 132 and lower coupler 134. Once again, any other material desired (e.g. wood, plastic, etc.), or any combination thereof, may be used to form the 2-cup plate 110.

Whereas FIG. 7, FIG. 8, FIG. 11, and FIG. 12 show shaft-mounted cup holders that are permanently affixed to the shaft or pole 140, the shaft-mounted cup holders can be made to slidably couple to the shaft or pole 140. That is, the shaft-mounted cup holders can be designed to fit loosely around the shaft or pole 140. For example, FIG. 13 shows a loosely fitted shaft-mounted 2-cup holder 1300. In this example, the shaft-mounted 2-cup holder 1300 includes the 2-cup plate 110 arranged between the upper coupler 132 and the lower coupler 134. A hole 1310 is provided along the upper coupler 132 and the lower coupler 134, wherein the hole 1310 is larger than the diameter of the shaft or pole 140. This allows the shaft or pole 140 to be easily inserted through the hole 1310 of the shaft-mounted 2-cup holder 1300. The lower coupler 134 may serve as a spacer between the 2-cup plate 110 and any another object, as shown in FIG. 14 and FIG. 15.

Namely, FIG. 14 and FIG. 15 show examples of the shaft-mounted 2-cup holder 1300 of FIG. 13 when in use. For example, FIG. 14 shows the shaft-mounted 2-cup holder 1300 aligned with the hole in the patio table 810. That is, for example, the shaft-mounted 2-cup holder 1300 is first set on the patio table 810, then the shaft or pole 140 of the table umbrella 820 is inserted through both the hole 1310 of shaft-mounted 2-cup holder 1300 and the hole in the patio table 810 (or vise versa). The shaft-mounted 2-cup holder 1300 may be loosely fitted around and held by the shaft or pole 140 while resting on the surface of the patio table 810.

In similar fashion, FIG. 15 shows the shaft-mounted 2-cup holder 1300 mounted on a beach umbrella 1500. In this example, the hollow shaft or pole 140 of beach umbrella 1500 has two segments (e.g., segments S1 and S2), wherein the bottom end of segment S1 is slidably fitted into the top end of segment S2, then tightened via a standard clamping fixture 142. In this example, a user holds the shaft-mounted 2-cup holder 1300 atop clamping fixture 142, then the bottom end of segment Si is slidably fitted through both the hole 1310 of shaft-mounted 2-cup holder 1300 and the top end of segment S2. Then, the clamping fixture 142 is tightened. The shaft-mounted 2-cup holder 1300 is loosely fitted around and held by the shaft or pole 140 while resting atop the clamping fixture 142. In certain other embodiments, umbrella 1500 may have only one segment, whereby a clamping feature 142 may be used in combination with 2-cup holder 1300. 2-cup holder 1300 may also be configured similar to the 4-cup holders discussed above.

Figure 16:
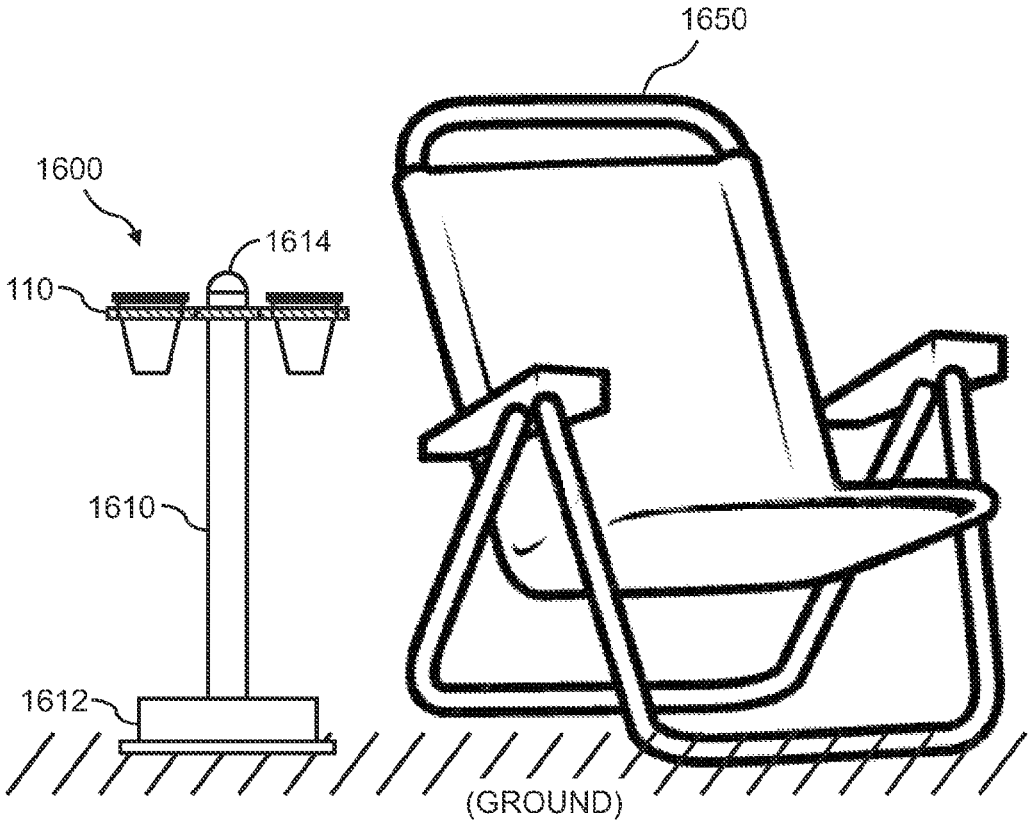
Figure 17:
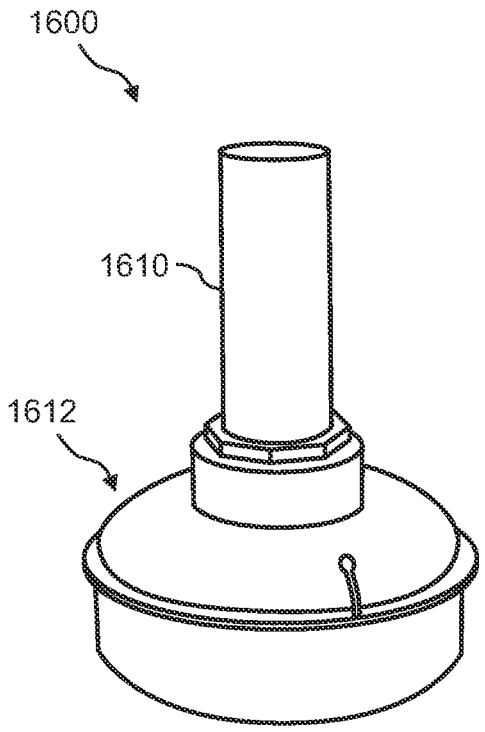

Referring now to FIG. 16, a side view of an example of a freestanding cup holder that is based on the cup holder assembly 100 shown in FIG. 1 is presented. In this example, a freestanding 2-cup holder 1600 includes the 2-cup plate 110 that is affixed to one end of a shaft 1610, while a base 1612 is provided at the opposite end of the shaft 1610, as shown. The shaft 1610 can be, for example, a length of hollow PVC pipe, such as 2-inch PVC pipe or 1.5-inch PVC pipe. The length of the shaft 1610 can typically be from about 12 inches to about 36 inches in one example, or about 30 inches in another example, or about 24 inches in yet another example. A decorative cap 1614 may be provided atop the shaft 1610. The freestanding 2-cup holder 1600 is designed for standing on the floor or ground. FIG. 16 shows the freestanding 2-cup holder 1600 in relation to a lawn or beach chair 1650. The base 1612 can be any width or diameter that is suitable for providing stability to the freestanding 2-cup holder 1600 in a particular environment. The width or diameter of the base 1612 can typically be from about 6 inches to about 24 inches in one example, or about 12 inches in another example. Optionally, the base 1612 can be weighted to provide further stability. FIG. 17 is a perspective view of another example of the base 1612 of freestanding 2-cup holder 1600.

Figure 18:
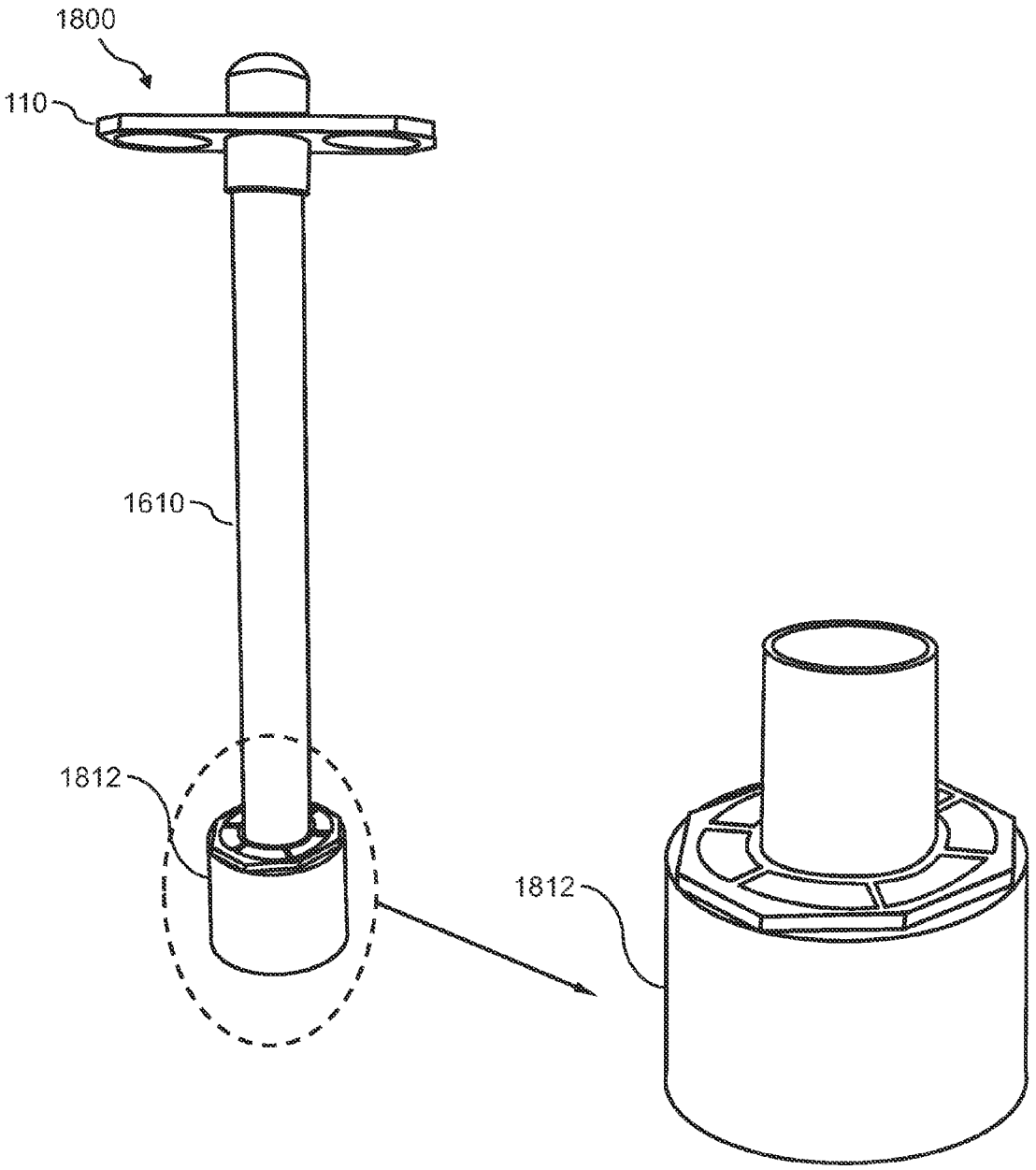

While the freestanding 2-cup holder 1600 may be designed to be portable, other types of freestanding cup holders are shown and described below with respect to FIG. 18 and FIG. 19. For example, FIG. 18 shows a perspective view of a freestanding 2-cup holder 1800. The freestanding 2-cup holder 1800 is substantially the same as the freestanding 2-cup holder 1600 shown in FIG. 16 except the base 1612 is replaced with a base 1812. In this example, the base 1812 is configured to be buried in a lawn, sand, or concrete. In this way, freestanding 2-cup holder 1800 may be a substantially permanent fixture in, for example, the user's yard, albeit the freestanding 2-cup holder 1800 may be moved by unburying the base 1812 and reburying the base 1812 in another location.

Figure 19:
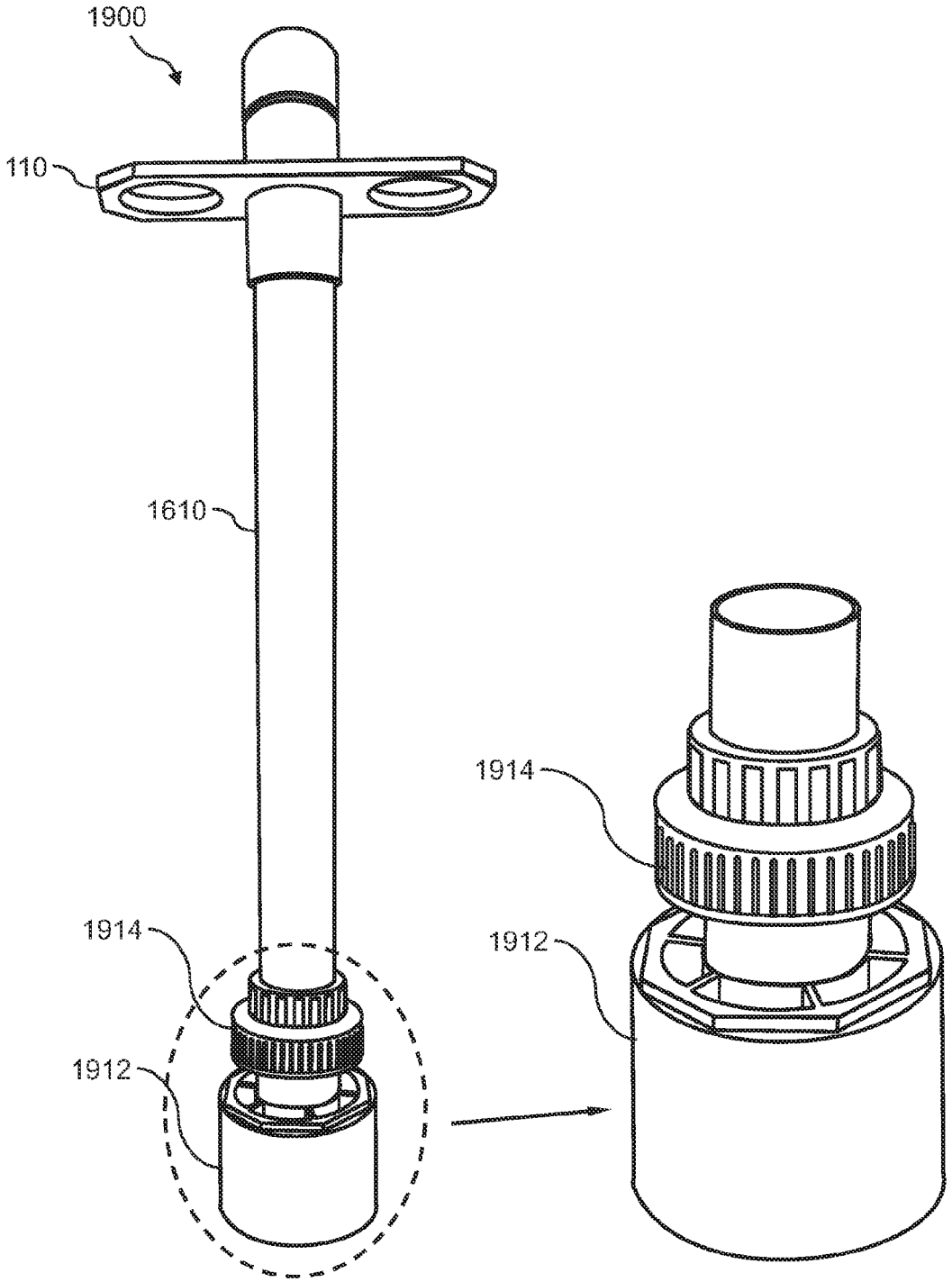

In another example, FIG. 19 shows a perspective view of a freestanding 2-cup holder 1900. The freestanding 2-cup holder 1900 is substantially the same as the freestanding 2-cup holder 1600 shown in FIG. 16 except the base 1612 is replaced with a base 1912. Further, the freestanding 2-cup holder 1900 is designed such that the shaft 1610 may be detached from the base 1912. For example, a threaded coupler 1914 may be provided at the bottom end of the shaft 1610 so that the shaft 1610 can be screwed and unscrewed from the base 1912. In this example, the base 1912 is designed to be permanently buried in the lawn, sand, or concrete, while the detachable portion of the freestanding 2-cup holder 1900 can be attached to or detached from the base 1912 at will.

In each of the examples discussed with reference to FIG. 12 to FIG. 19, 4-cup plates like those various embodiments discussed above (e.g. 4-cup plate 410) may be used in place of the 2-cup plates (e.g. 2-cup plate 110) presented.

Referring now to FIG. 20, a side view of an example of a tabletop cup holder that is based on the cup holder assembly 100 shown in FIG. 1 is presented. In this example, a tabletop 2-cup holder 2000 includes the 2-cup plate 110 that is affixed to one end of a shaft 2010, while a base 2012 is provided at the opposite end of the shaft 2010, as shown. The shaft 2010 can be, for example, a length of hollow PVC pipe, such as 1-inch, 1.5-inch, or 2-inch PVC pipe. The length of the shaft 2010 can typically be from about 2 inches to about 8 inches in one example, or about 4 inches in another example. A decorative cap 2014 may be provided atop the shaft 2010. The tabletop 2-cup holder 2000 is designed for setting on any surface, such as a tabletop surface of table 810.

Referring now to FIG. 21 is a perspective view of another example of a tabletop cup holder that is based on the cup holder assembly 100 shown in FIG. 3. In this example, a tabletop 4-cup holder 2100 includes the 2-cup plates 110*a* and 110*b* that are affixed to one end of a shaft 2110, while a base 2112 is provided at the opposite end of the shaft 2110, as shown. The shaft 2110 can be, for example, a length of hollow PVC pipe, such as 1-inch, 1.5-inch, or 2-inch PVC pipe. The length of the shaft 2110 can typically be from about 2 inches to about 8 inches in one example, or about 4 inches in another example. The tabletop 4-cup holder 2100 is designed for setting on any surface, such as a tabletop surface.

Referring now to FIG. 22 through FIG. 32, various views of a 2-plate cup holder system 2200 that can be sized and configured in various ways are presented. The 2-plate cup holder system 2200 includes a top plate 2210 and a bottom plate 2220, wherein the top plate 2210 is mechanically coupled to one end of a shaft 2230 and the bottom plate 2220 is mechanically coupled to the other end of the shaft 2230.

The top plate 2210 and the bottom plate 2220 are disc-shaped. The diameters of the top plate 2210 and the bottom plate 2220 can vary. For example, the diameters of the top plate 2210 and the bottom plate 2220 can be from about 9 inches to about 14 inches. In one example, using the shaft 2230, the top plate 2210 and the bottom plate 2220 are spaced about 4 inches apart. In other examples, the top plate 2210 and the bottom plate 2220 are spaced about 6 inches apart. In certain other examples, the top plate 2210 and the bottom plate 2220 are spaced about 8 inches apart. Further, the shaft 2230 is hollow and its diameter can vary depending on the type of cup holder desired. Additionally, the top plate 2210 and the bottom plate 2220 can be secured to the ends of the shaft 2230 in various ways. For example, snap-fitted rings, snap-fitted caps, snap-fitted pipes, threaded rings, threaded caps, threaded pipes, glued rings, glued caps, glued pipes, and the like can be used. In one example, FIG. 22 shows a ring 2240 that can be snap-fitted onto the end of the shaft 2230.

In one example, the 2-plate cup holder system 2200 can be formed of individual plastic components that are assembled together. In another example, the top plate 2210, the bottom plate 2220, and the shaft 2230 are formed as a one piece molded plastic component.

The 2-plate cup holder system 2200 may be configured in various ways. In one example, the 2-plate cup holder system 2200 can be configured as a tabletop cup holder without an umbrella. In another example, the 2-plate cup holder system 2200 can be configured as a tabletop cup holder with an umbrella. In yet another example, the 2-plate cup holder system 2200 can be configured as a free standing cup holder.

Figure 22:
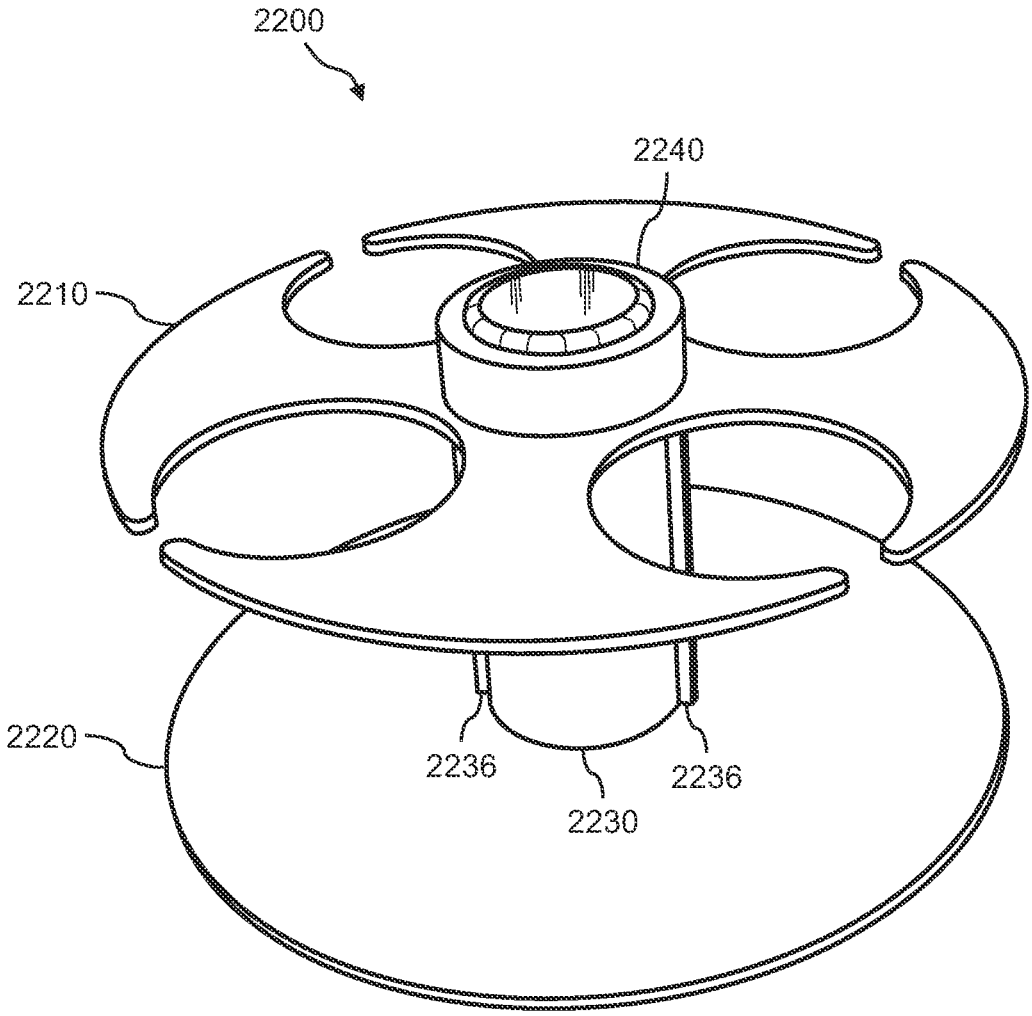

In the example shown in FIG. 22, the 2-plate cup holder system 2200 has a 9.5-inch diameter. In this example, the 2-plate cup holder system 2200 uses the top plate 2210 shown in FIG. 23 and the bottom plate 2220 shown in FIG. 24, wherein both the top plate 2210 and the bottom plate 2220 have a diameter D of about 9.5 inches and a thickness t of about 0.125 inches. The top plate 2210 has a center opening 2214 and the bottom plate 2220 has a center opening 2224. The center openings 2214, 2224 have a diameter d1. The footprint of the center openings 2214, 2224 substantially matches the cross-sectional footprint of the shaft 2230. More details of examples of the shaft 2230 are shown in FIG. 25A, FIG. 25B, FIG. 26A, and FIG. 26B.

Namely, because the shaft 2230 is keyed, the center opening 2214 of the top plate 2210 has two opposing key slots 2216. Likewise, the center opening 2224 of the bottom plate 2220 has two opposing key slots 2226. The diameter d1 can vary depending on the diameter of the shaft 2230. In one example, the diameter d1 is about 1.9375 inches, which is used for a 2-inch diameter shaft 2230. In another example, the diameter d1 is about 1.375 inches, which is used for a 1.5-inch diameter shaft 2230. In the example shown in FIG. 22, the diameter d1 of the center openings 2214, 2224 is about 1.9375 inches.

Figure 23:
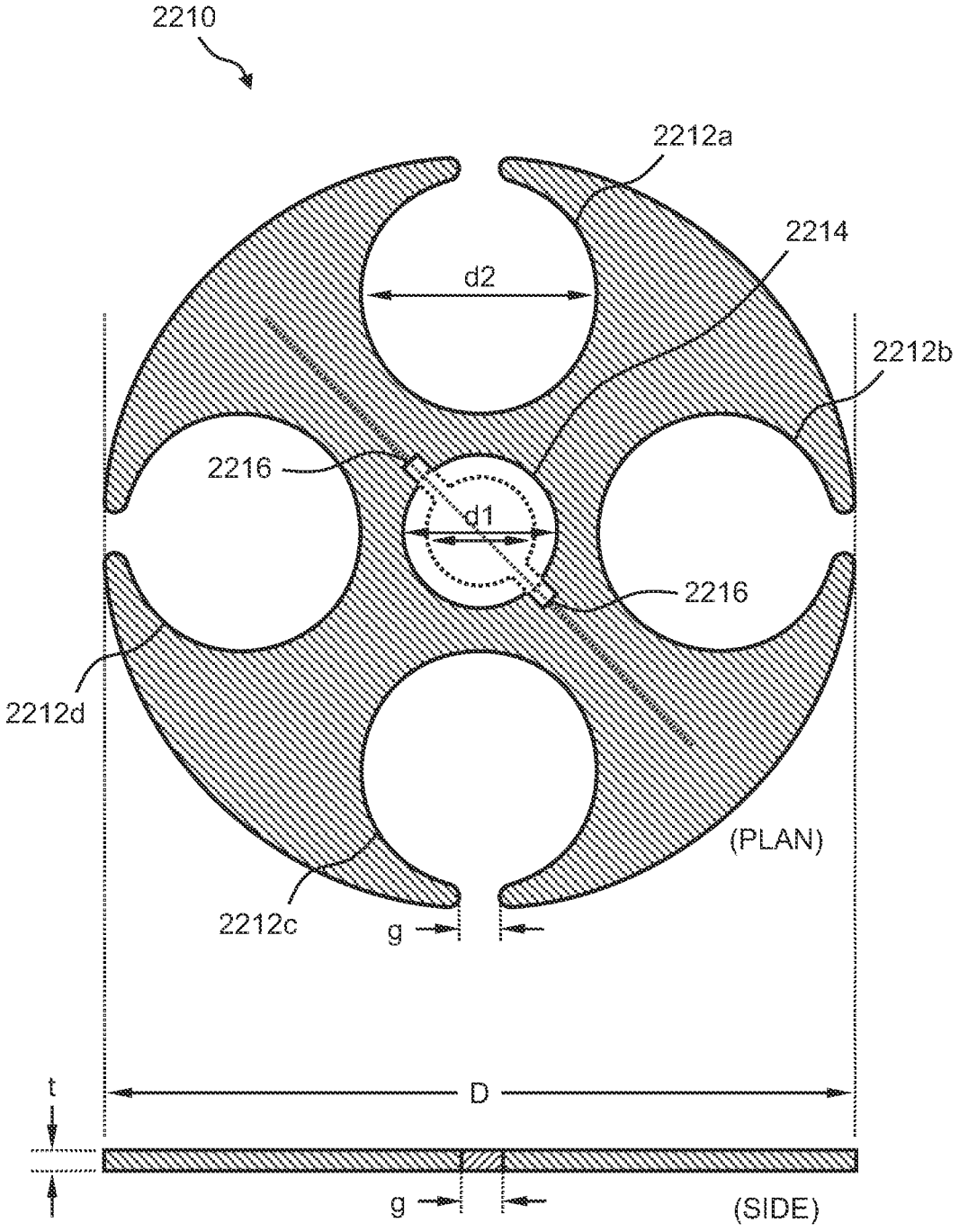
Figure 24:
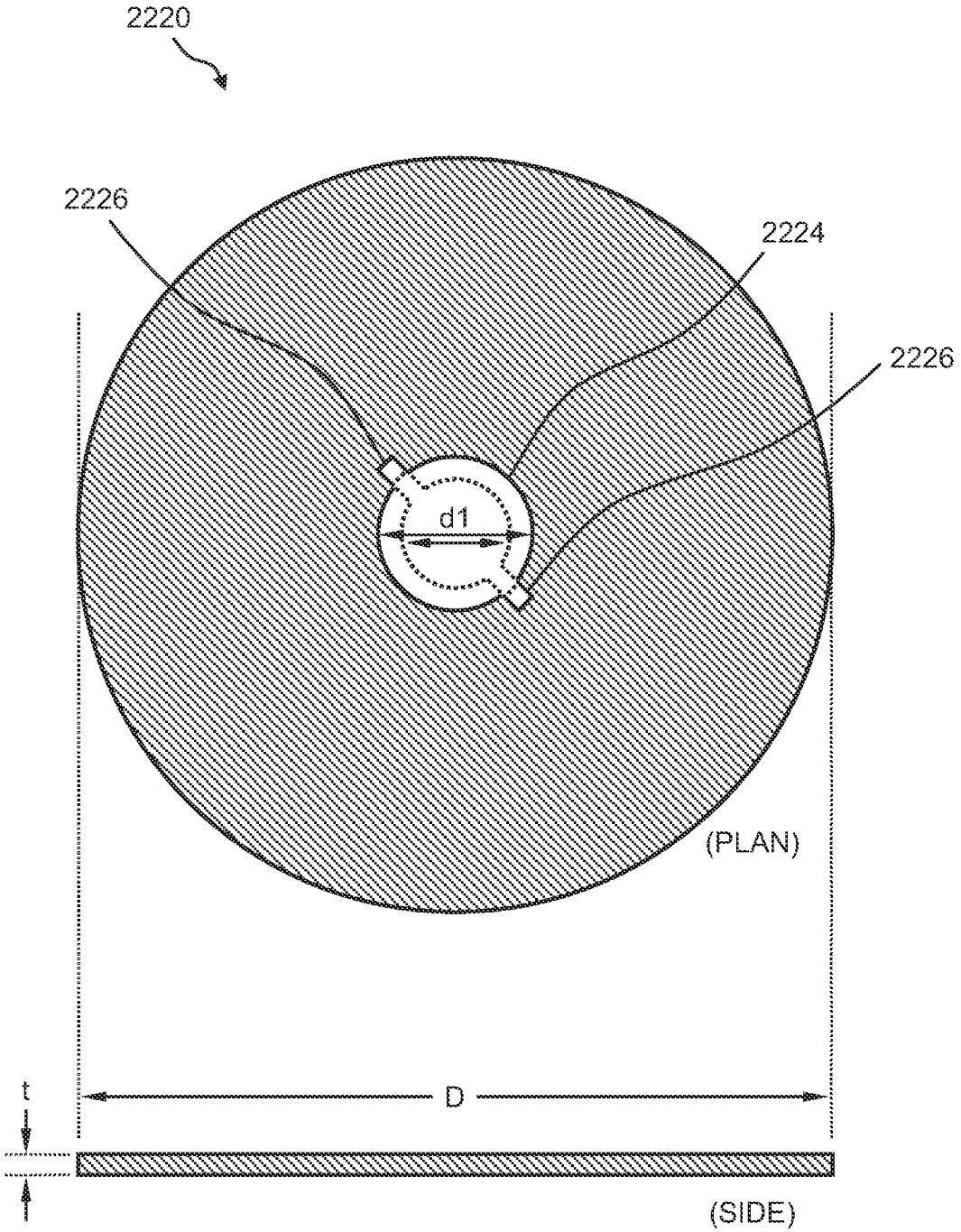

Referring now to FIG. 23, the top plate 2210 has four cup holes 2212 (e.g., cup holes 2212*a*, 2212*b*, 2212*c*, 2212*d*). Each of the cup holes 2212 has a diameter d2 of, for example, about 3 inches. The cup holes 2212*a*, 2212*b*, 2212*c*, 2212*d* may be substantially evenly spaced radially about the center opening 2214. Further, in this example, the outermost edge of the cup holes 2212 may be positioned about 0.25 inches away from the outer edge of the top plate 2210. Further still, at the closest point of each cup hole 2212 to the edge of the top plate 2210 there may be a gap g, configured to enable, for example, the stem of a wine glass to pass through into the opening. In one example, the gap g is about 0.5 inches.

Further, to ensure the structural integrity of the 9.5-inch top plate 2210, there is a preferred orientation of the key slots 2216 with respect to the layout of the four cup holes 2212. Namely, it is preferable that the line of the key slots 2216 passes between the cup holes 2212 (as shown) and not be directed toward the cup holes 2212.

Figure 25A:
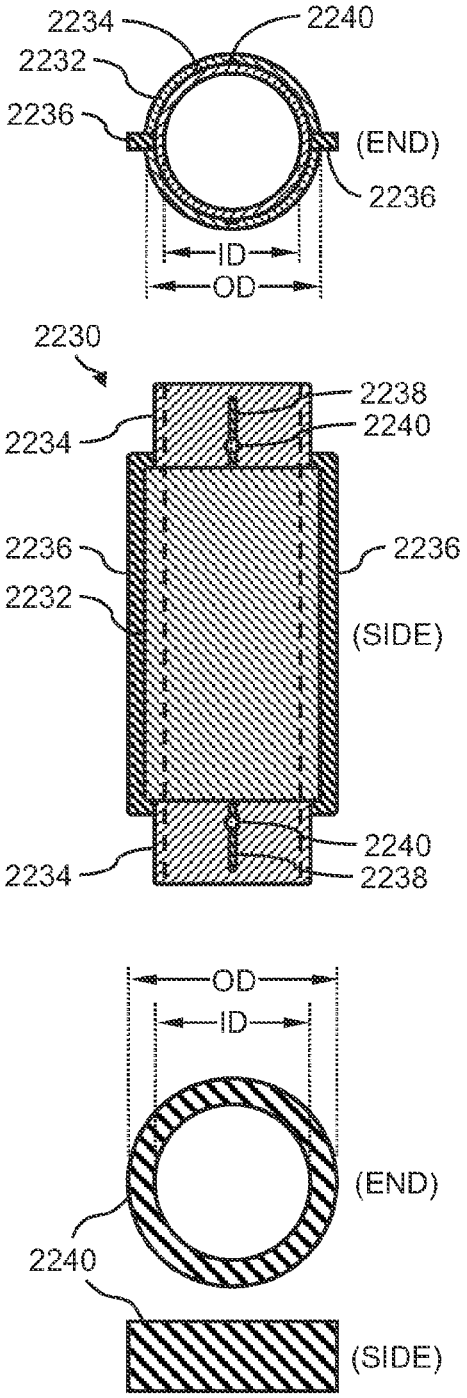
Figure 25B:
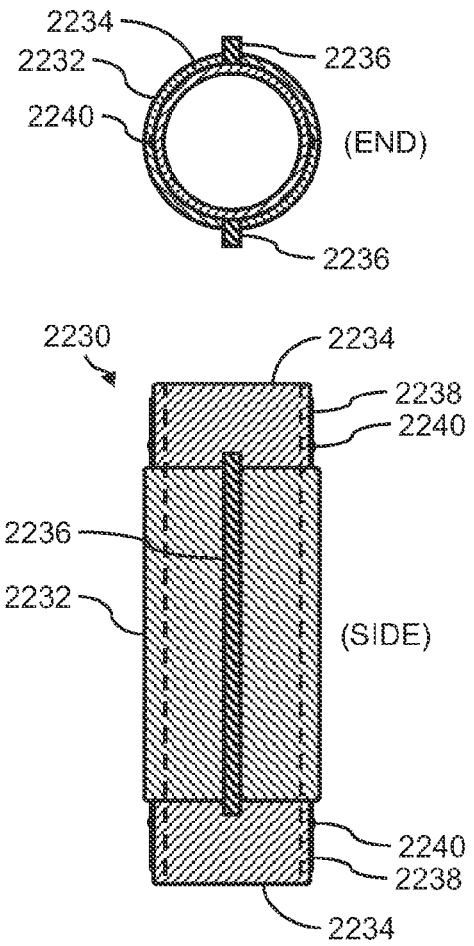

Referring now to FIG. 25A, FIG. 25B, various views of an exemplary 2-inch diameter shaft 2230 is shown. Namely, FIG. 25A shows an end view and a side view of the 2-inch diameter shaft 2230. FIG. 25B shows a different end view and side view of the 2-inch diameter shaft 2230. Further, FIG. 25A shows an example of the ring 2240 that can be snap-fitted onto the 2-inch diameter shaft 2230. The 2-inch diameter shaft 2230 may be designed to slide onto, for example, an umbrella pole.

Generally, the shaft 2230 includes a center portion 2232, and two end portions 2234. In one example, the center portion 2232 has a length of about 4 inches and each of the end portions 2234 has a length of about 1 inch. Therefore, the overall length of the shaft 2230 can be about 6 inches. In other examples, the center portion 2232 has a length of about 6 inches and each of the end portions 2234 has a length of about 1 inch. Therefore, the overall length of the shaft 2230 may also be about 8 inches. Further, on each side of the center portion 2232 is a protruding ridge 2236, which serves at the key for fitting into the center opening 2214 of the top plate 2210 and the center opening 2224 of the bottom plate 2220. In this example, the shaft 2230 has an outside diameter (OD) of about 2 inches and an inside diameter (ID) of about 1.5625. The overall width including the protruding ridges 2236 is about 2.25 inches. The key slots 2216 of the center opening 2214 of the top plate 2210 are designed to receive the protruding ridges 2236 of the shaft 2230. Likewise, the key slots 2226 of the center opening 2224 of the bottom plate 2220 are designed to receive the protruding ridges 2236 of the shaft 2230.

The ring 2240 is designed to be snap-fitted onto the end portion 2234 the shaft 2230. Accordingly, the end portions 2234 the shaft 2230 include certain features of assisting the coupling of ring 2240. For example, two opposing rib features 2238 are provided on each end portion 2234. Namely, each rib feature 2238 is an elongated feature that slightly protrudes from the surface of the end portion 2234. In one example, the rib feature 2238 has a length of about 0.75 inches. The presence of the two opposing rib features 2238 on the end portion 2234 ensures a snug fit for the ring 2240 onto the end portion 2234. In this example, the ring 2240 has an OD of about 2.5 inches, an ID of about 1.938 inches, and a height of about 0.75 inches.

Further, a snap feature 2240 may be provided along each rib feature 2238, near the edge of the center portion 2232. The snap feature 2240 may be a protruding dome-shaped bump that is slightly higher than the rib feature 2238. In one example, the snap feature 2240 has a height of about 0.05 inches with respect to the surface of the end portion 2234 and has a diameter of about 0.4 inches. The snap features 2240 are used for securing the top plate 2210 and the bottom plate 2220 to the end portions 2234 of the shaft 2230. Namely, the top plate 2210 snaps between snap features 2240 and the edge of the center portion 2232 of the shaft 2230.

Figure 26A:
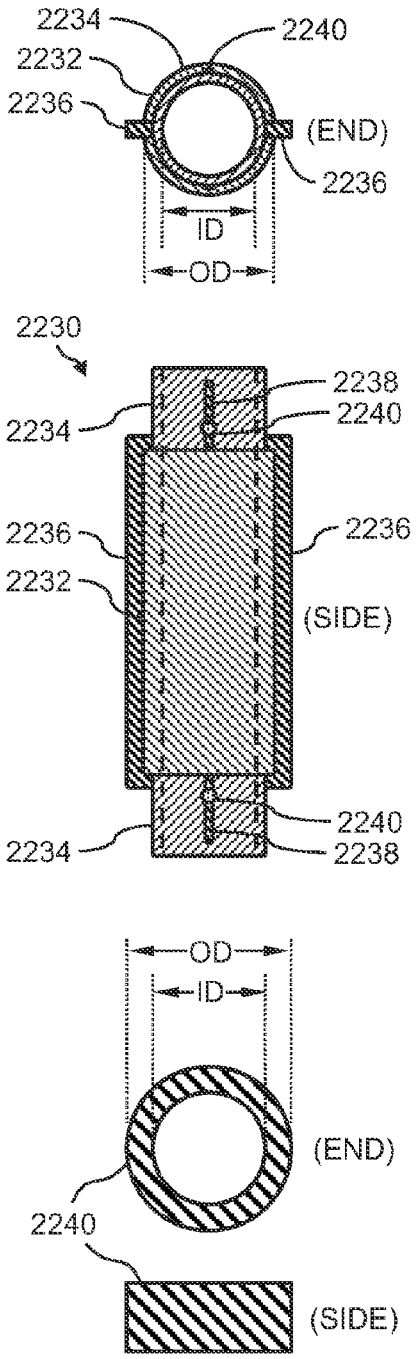
Figure 26B:
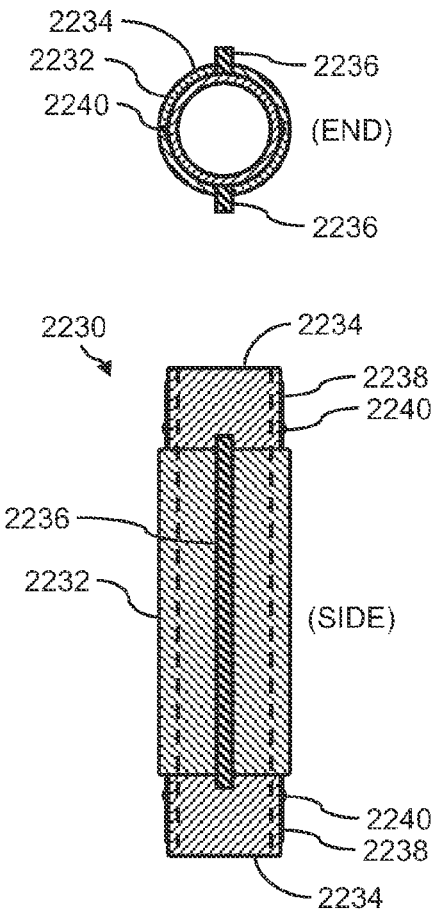

Referring now to FIG. 26A, FIG. 26B, various views of an example of a 1.5-inch diameter shaft 2230 are presented. Namely, FIG. 26A shows an end view and a side view of the 1.5-inch diameter shaft 2230. FIG. 26B shows a different end view and side view of the 1.5-inch diameter shaft 2230. Further, FIG. 26A shows an example of the ring 2240 that can be snap-fitted onto the 1.5-inch diameter shaft 2230.

The 1.5-inch diameter shaft 2230 is substantially the same as the 2-inch diameter shaft 2230 except that the 1.5-inch diameter shaft 2230 has an OD of about 1.5 inches and an ID of about 1 inch. Further, the overall width of the 1.5-inch diameter shaft 2230 including the protruding ridges 2236 is about 1.75 inches. Additionally, for the 1.5-inch diameter shaft 2230, the ring 2240 has an OD of about 2 inches, an ID of about 1.312 inches, and a height of about 0.75 inches.

Figure 27:
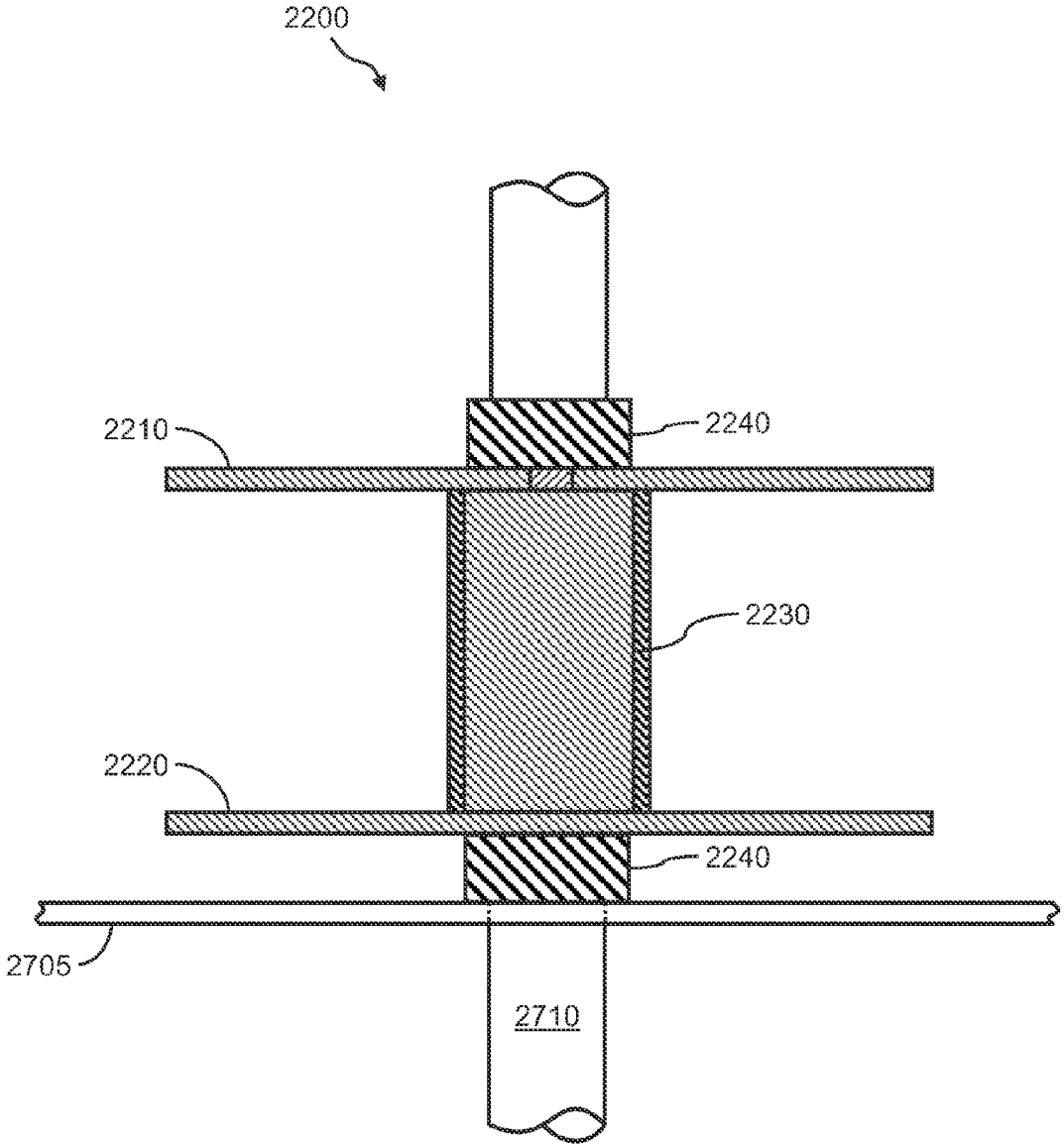

The example of the 2-plate cup holder system 2200 shown in FIG. 22 may use the 9.5-inch top plate 2210, the 9.5-inch bottom plate 2220, and the 2-inch diameter shaft 2230. This configuration is an example of a tabletop cup holder that may be used with an umbrella. For example, FIG. 27 shows the 2-plate cup holder system 2200 of FIG. 22 resting atop a tabletop 2705 and an umbrella pole 2710 passing through the, for example, 2-inch diameter shaft 2230. In this way, the 2-plate cup holder system 2200 is secured atop the tabletop 2705. In another example, the 2-plate cup holder system 2200 shown in FIG. 22 can be used with the umbrella alone, without the table. For example, the 2-inch diameter shaft 2230 may be coupled to the umbrella pole 2710 via a securing means such as, for example, a screw, adhesive, snap feature, or any combination thereof.

Figure 28:
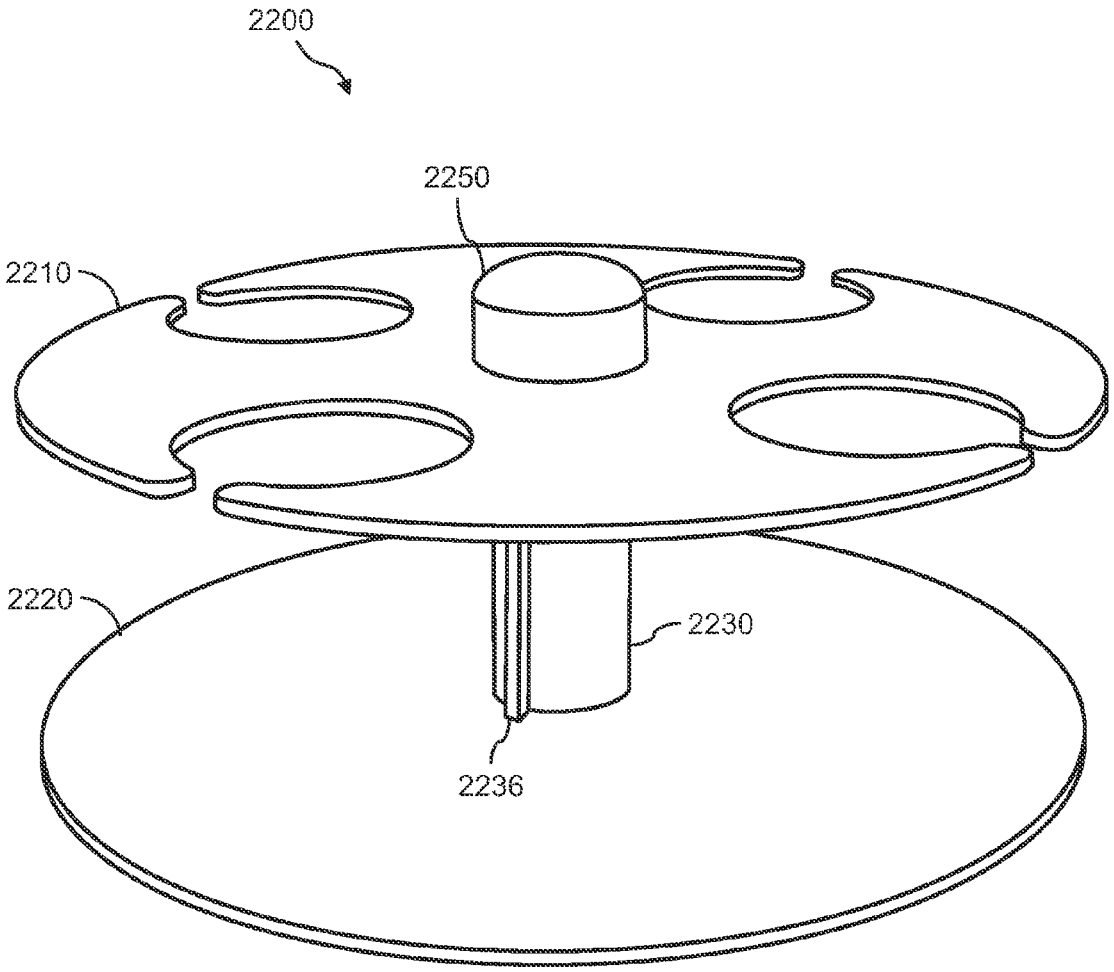
Figure 29:
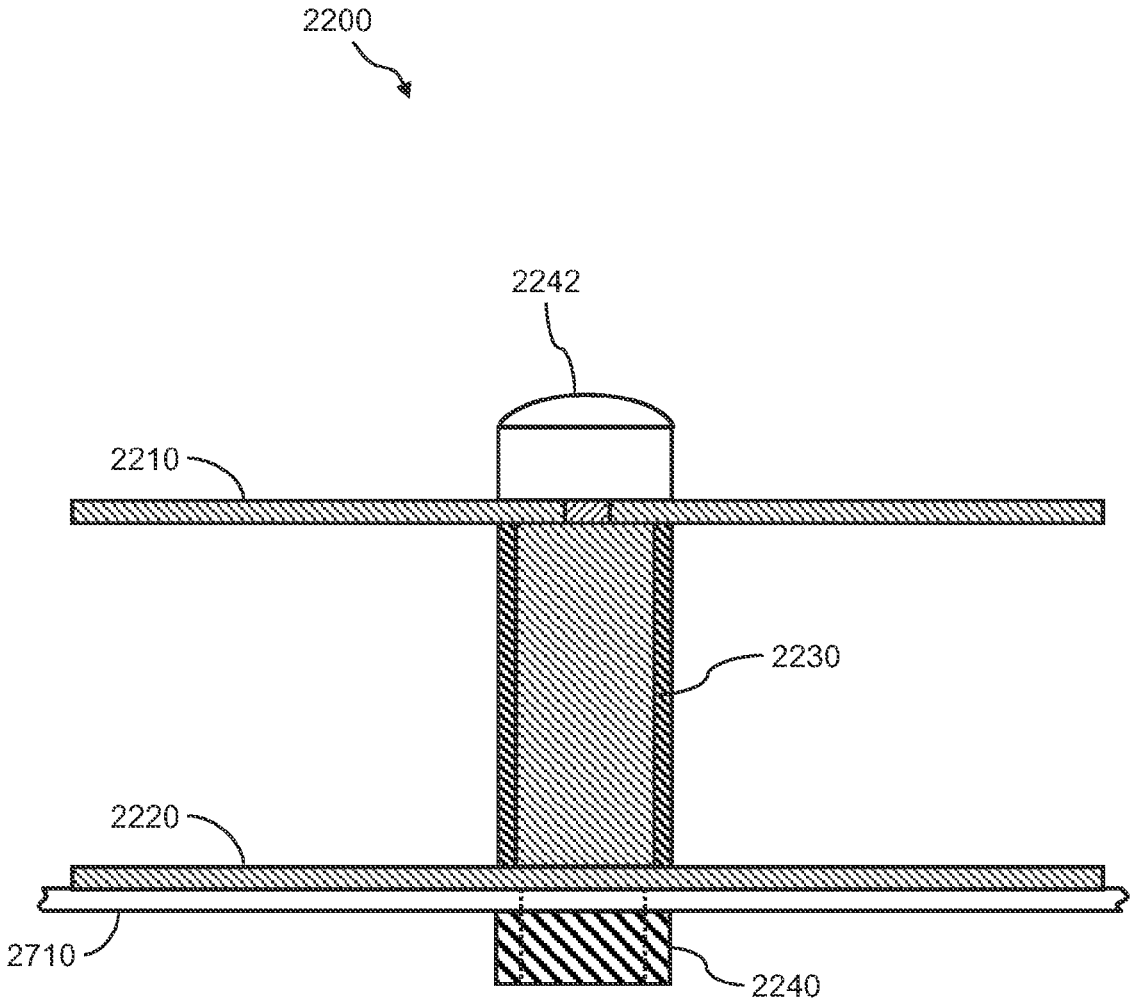

In another example of the 2-plate cup holder system 2200, FIG. 28 shows an example of the 2-plate cup holder system 2200 that is configured as a tabletop cup holder alone, without using an umbrella. Namely, the 2-plate cup holder system 2200 shown in FIG. 28 is configured to be fitted into the hole in the tabletop and secured to the tabletop, as shown in FIG. 29. For example, the 2-plate cup holder system 2200 shown in FIG. 28 may include an 11.5-inch top plate 2210, a 11.5-inch bottom plate 2220, and the 1.5-inch diameter shaft 2230. As shown in FIG. 29, the bottom end portion 2234 of the 1.5-inch diameter shaft 2230 may fit through the hole in the tabletop 2705, then the ring 2240 may be snap-fitted thereon. Further, instead of a ring 2240 at the top end portion 2234 of the 1.5-inch diameter shaft 2230, a decorative cap 2242 can be snap-fitted thereon.

Figure 30:
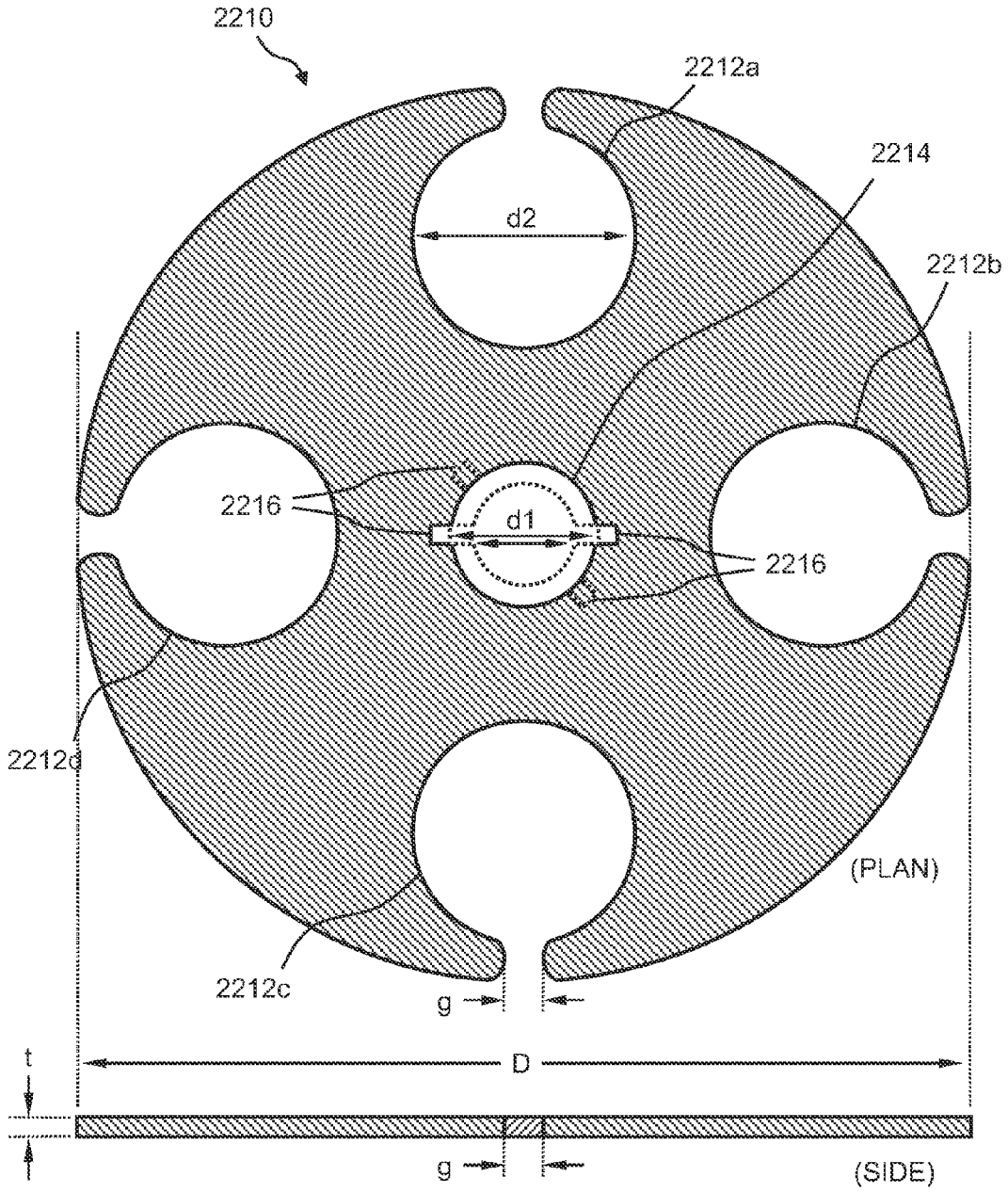
Figure 31:
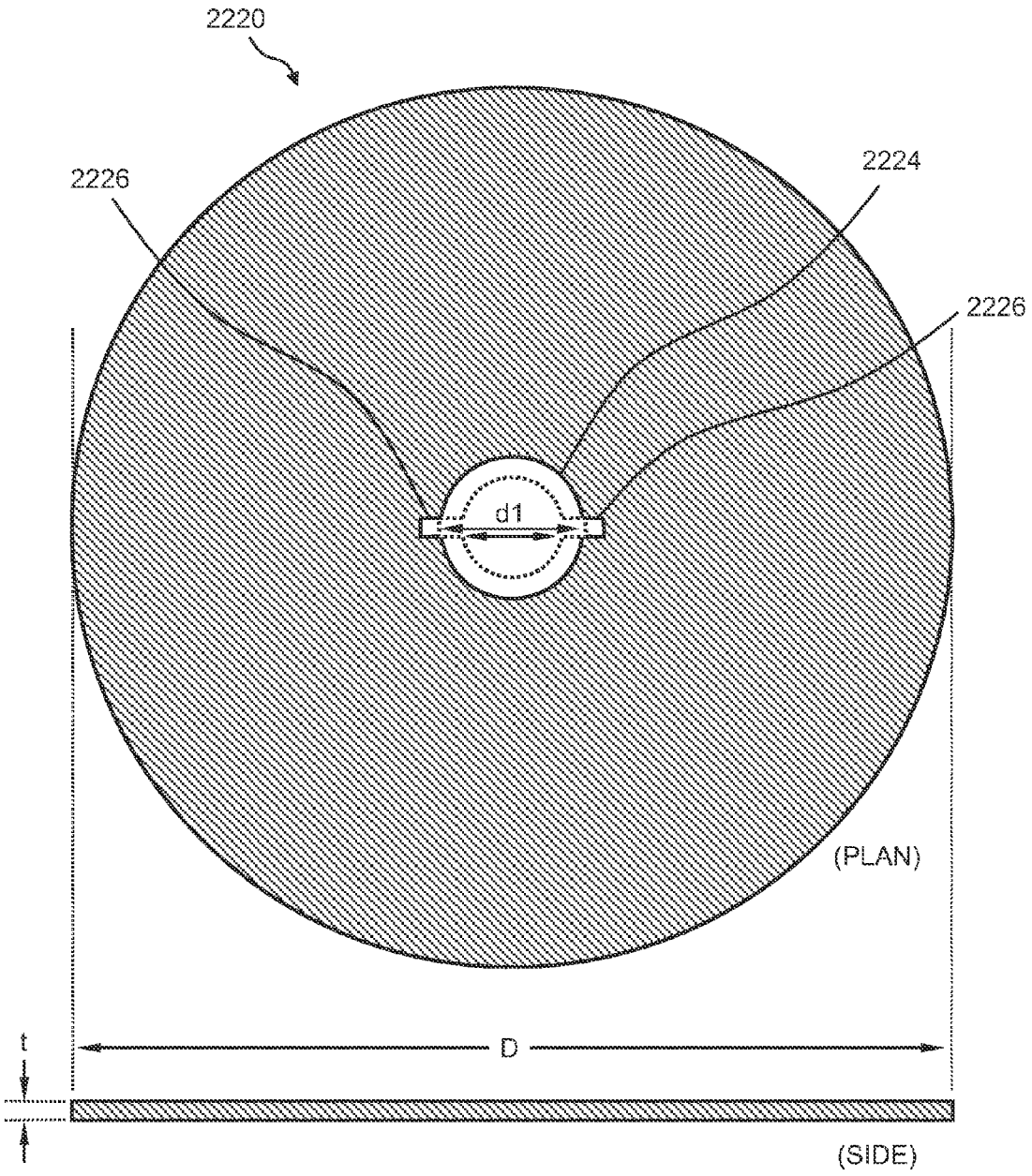

FIG. 30 shows a plan and a side view of an example of the exemplary 11.5-inch top plate 2210. FIG. 31 shows a plan and a side view of an example of the exemplary 11.5-inch bottom plate 2220. Each has a diameter D of about 11.5 inches (D may be other dimensions as desired). Referring now to FIG. 30, the exemplary 11.5-inch top plate 2210 has four cup holes 2212 (e.g., cup holes 2212*a*, 2212*b*, 2212*c*, 2212*d*). Each of the cup holes 2212 has a diameter d2 of, for example, about 3 inches. The cup holes 2212*a*, 2212*b*, 2212*c*, 2212*d* may be substantially evenly spaced radially about the center opening 2214. Further, in this example, the outer most edge of the cup holes 2212 may be positioned about 0.5 inches away from the outer edge of the top plate 2210. Further, at the closest point of each cup hole 2212 to the edge of the top plate 2210 there may be a gap g. Again, the size of the center opening 2214 can vary depending on the size of the desired shaft 2230. In the exemplary 11.5-inch top plate 2210, the key slots 2216 can generally have substantially any orientation with respect to the layout of the four cup holes 2212.

Figure 32:
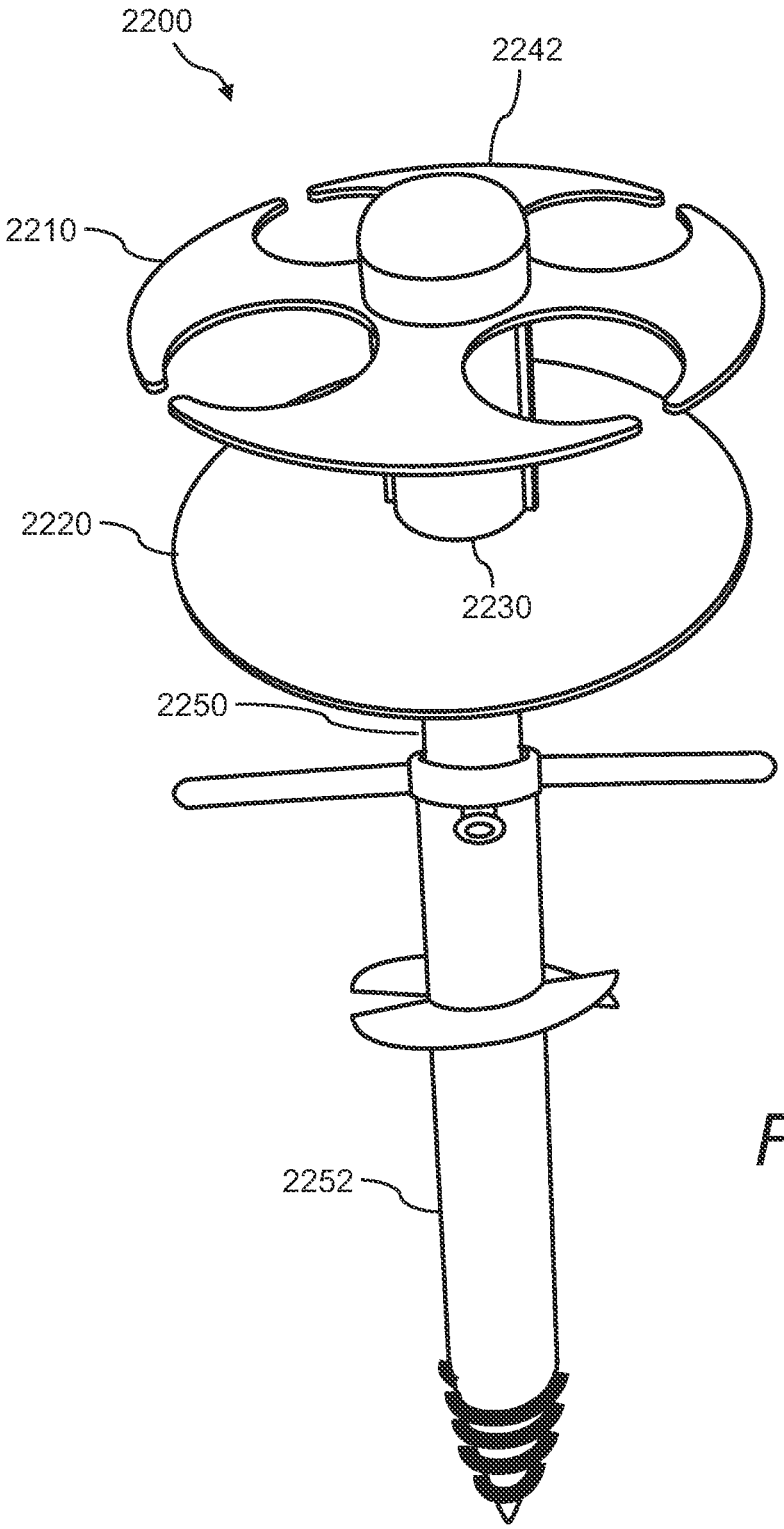

Referring now to FIG. 32, a perspective view of an example of the 2-plate cup holder system 2200 that is configured as a freestanding cup holder is presented. In this example, the 2-plate cup holder system 2200 may include the decorative cap 2242. Further, the bottom end portion 2234 of the shaft 2230 is mechanically coupled to a pipe 2250, such as, for example, to a 1-inch diameter PVC pipe of any desired length. In one example, a threaded coupler is provided at the bottom end of the shaft 2230 so that the pipe 2250 can be easily removed. In other examples, the pipe 2250 itself can be pushed directly into the sand or ground for standing up the 2-plate cup holder system 2200. In yet another example, the bottom end of the pipe 2250 can be inserted into an anchor device 2252 which is then installed into the sand or ground for standing up the 2-plate cup holder system 2200. For example, the anchor device 2252 may be any standard beach umbrella anchor/holder.

Referring again to FIG. 22 through FIG. 32, the components of the 2-plate cup holder system 2200 can be arranged in various combinations depending on the size and type of cup holder desired. In one example, the 2-plate cup holder system 2200 can include the 9.5-inch top plate 2210, the 9.5-inch bottom plate 2220, and the 2-inch diameter shaft 2230. In another example, the 2-plate cup holder system 2200 can include the 9.5-inch top plate 2210, the 9.5-inch bottom plate 2220, and the 1.5-inch diameter shaft 2230. In yet another example, the 2-plate cup holder system 2200 can include the 11.5-inch top plate 2210, the 11.5-inch bottom plate 2220, and the 2-inch diameter shaft 2230. In yet another example, the 2-plate cup holder system 2200 can include the 11.5-inch top plate 2210, the 11.5-inch bottom plate 2220, and the 1.5-inch diameter shaft 2230. These combinations of components can be used to provide, for example, the 2-plate cup holder system 2200 configured as a tabletop cup holder without an umbrella, the 2-plate cup holder system 2200 configured as a tabletop cup holder with an umbrella, or the 2-plate cup holder system 2200 configured as a free standing cup holder.

Further, in the 2-plate cup holder system 2200, while plastic or paper cups may suspend from the cup holes 2212 in the top plate 2210, the bottom plate 2220 may be provided for other drinking receptacles, such as bottles or wine glasses. In this example, the bottle or wine glass will pass through the cup holes 2212 in the top plate 2210 and rest on the bottom plate 2220. In this way, the presently disclosed 2-plate cup holder system 2200 provides a universal cup holder function. Further, because the shaft 2230 is keyed with respect to the top plate 2210 and the bottom plate 2220, the two plates cannot rotate independent of one another, thereby preventing spillage due to the top plate 2210 rotating without the bottom plate 2220 or the bottom plate 2220 rotating without the top plate 2210. However, while there may be an increased the risk of spilling, any table top configuration of the 2-plate cup holder system 2200 can omit the bottom plate 2220.

Additionally, the presently disclosed 2-plate cup holder system 2200 is not limited to the diameters shown and described herein above nor is it limited to four cup holes 2212. The 2-plate cup holder system 2200 can include any number of cup holes 2212 that can be practically fitted in the top plate 2210 depending on the size of the top plate 2210. Further, in other examples of the 2-plate cup holder system 2200, the gap g is omitted from the top plate 2210.

Figure 33:
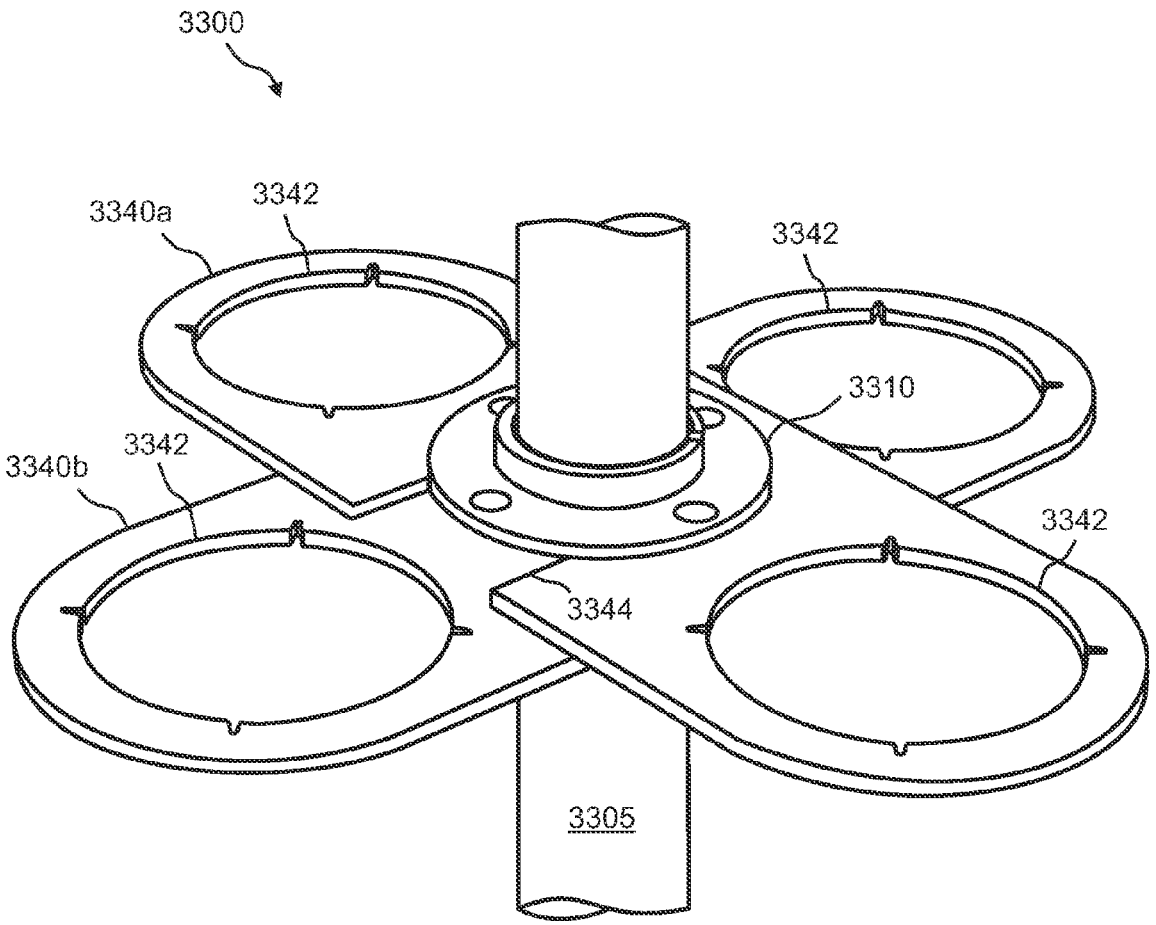

Referring now to FIG. 33 through FIG. 45, various views of an umbrella-mounted cup holder system 3300 are presented. Namely, FIG. 33 shows a perspective view of one example of the presently disclosed umbrella-mounted cup holder system 3300. The umbrella-mounted cup holder system 3300 may include a pair of pole mounts 3310 and a pair of 2-cup plates 3340 (e.g., 2-cup plates 3340*a*, 3340*b*). The 2-cup plates 3340*a*, 3340*b* may be oriented substantially orthogonal to each other as shown. Each of the 2-cup plates 3340 includes two cup holes 3342 and a slot 3344, wherein the slot 3344 provides clearance for a beach umbrella pole, such as a pole 3305. Therefore, together the 2-cup plates 3340*a*, 3340*b* provide a 4-cup umbrella-mounted cup holder. More details of the 2-cup plate 3340 are shown and described herein below with reference to FIG. 40 through FIG. 43B.

Figure 34:
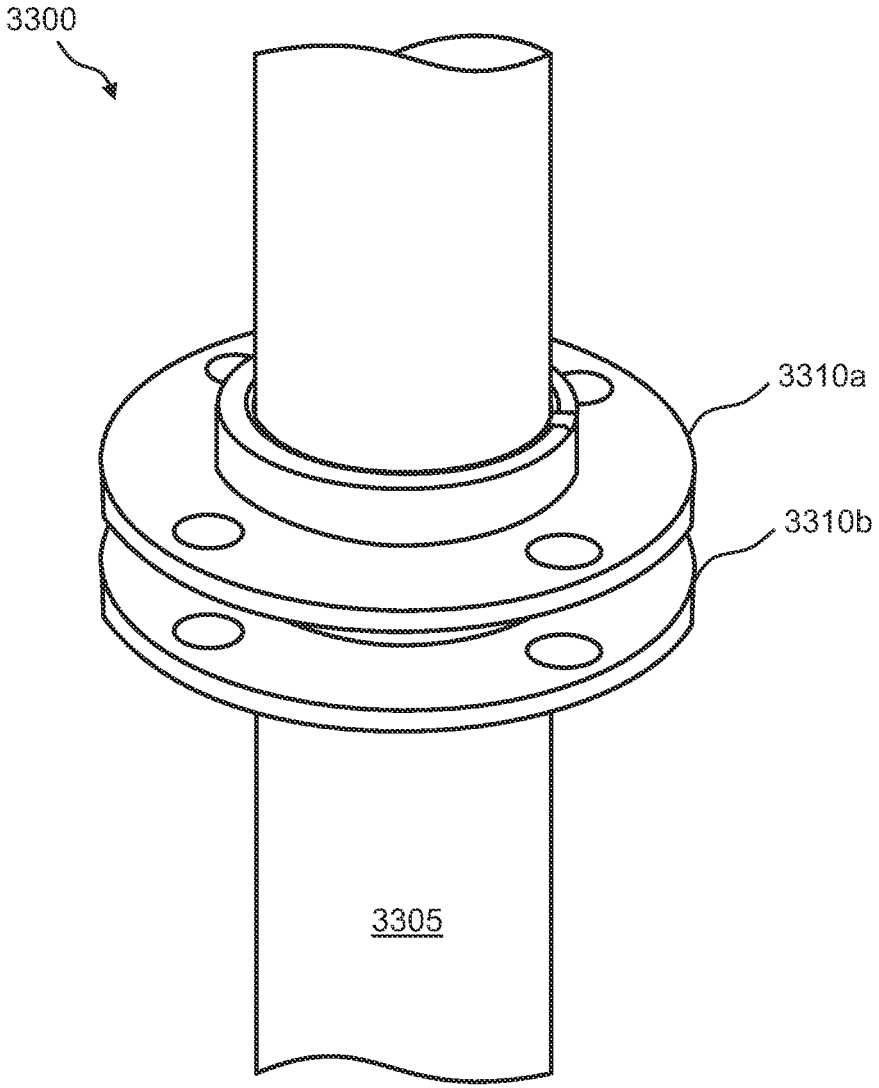
Figure 35:
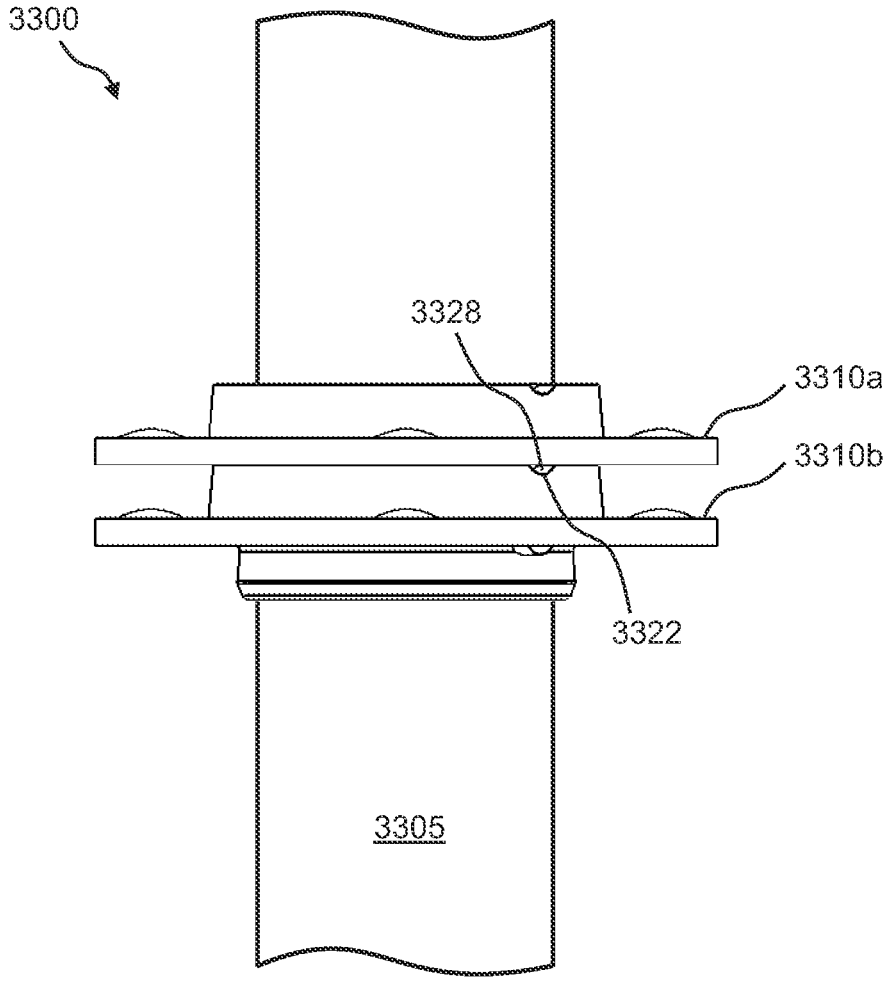
Figure 36:
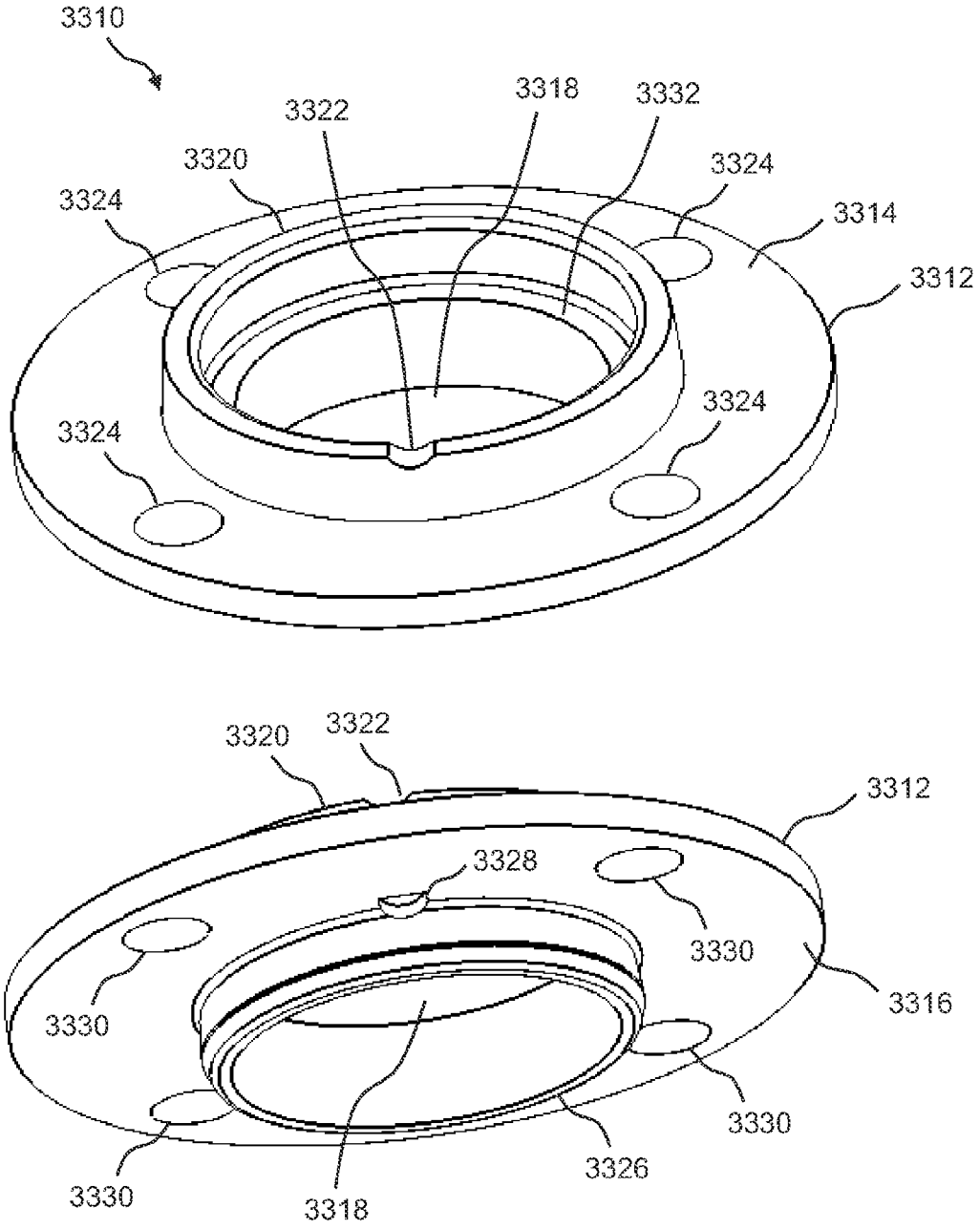
Figure 37:
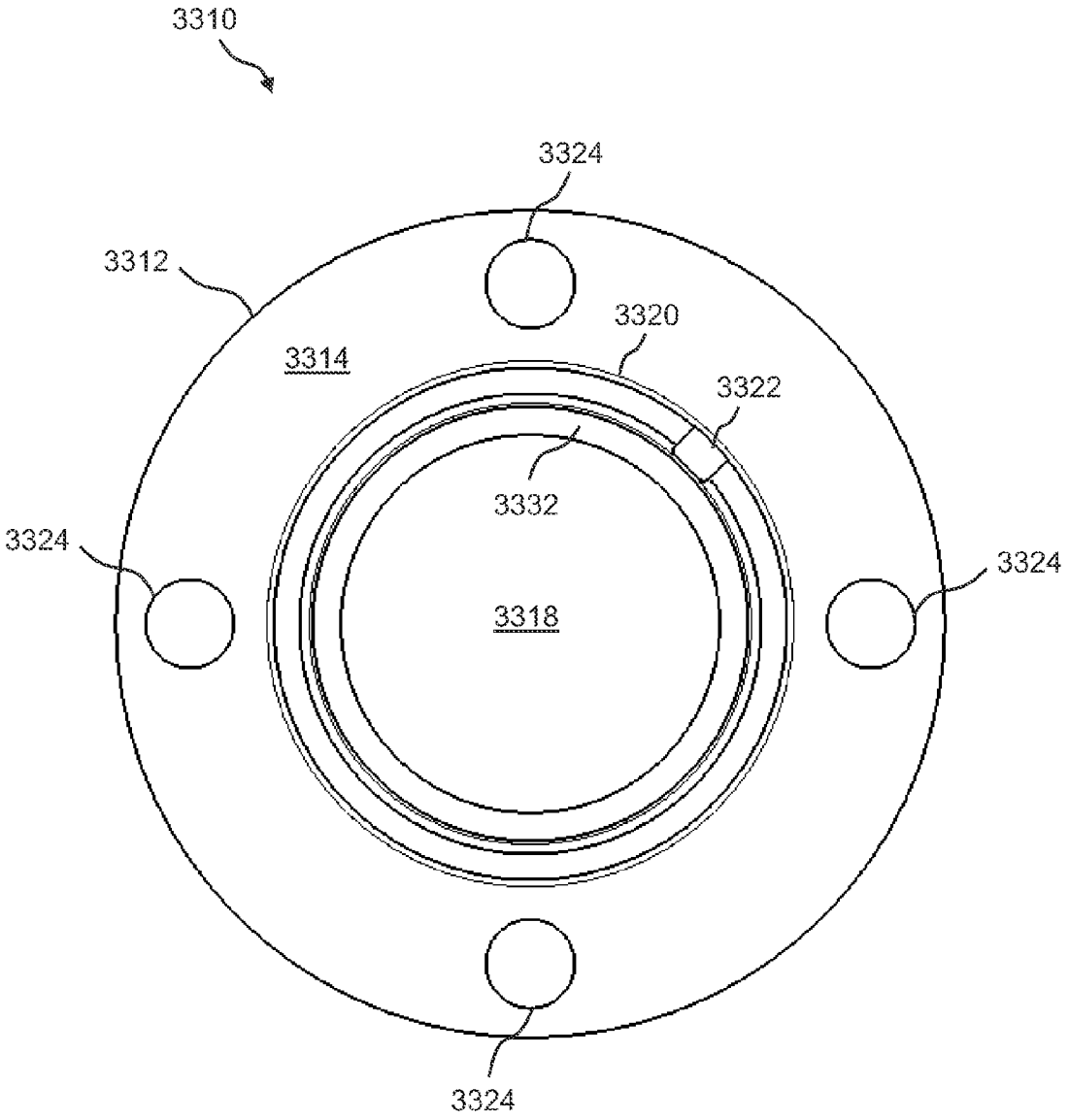
Figure 38:
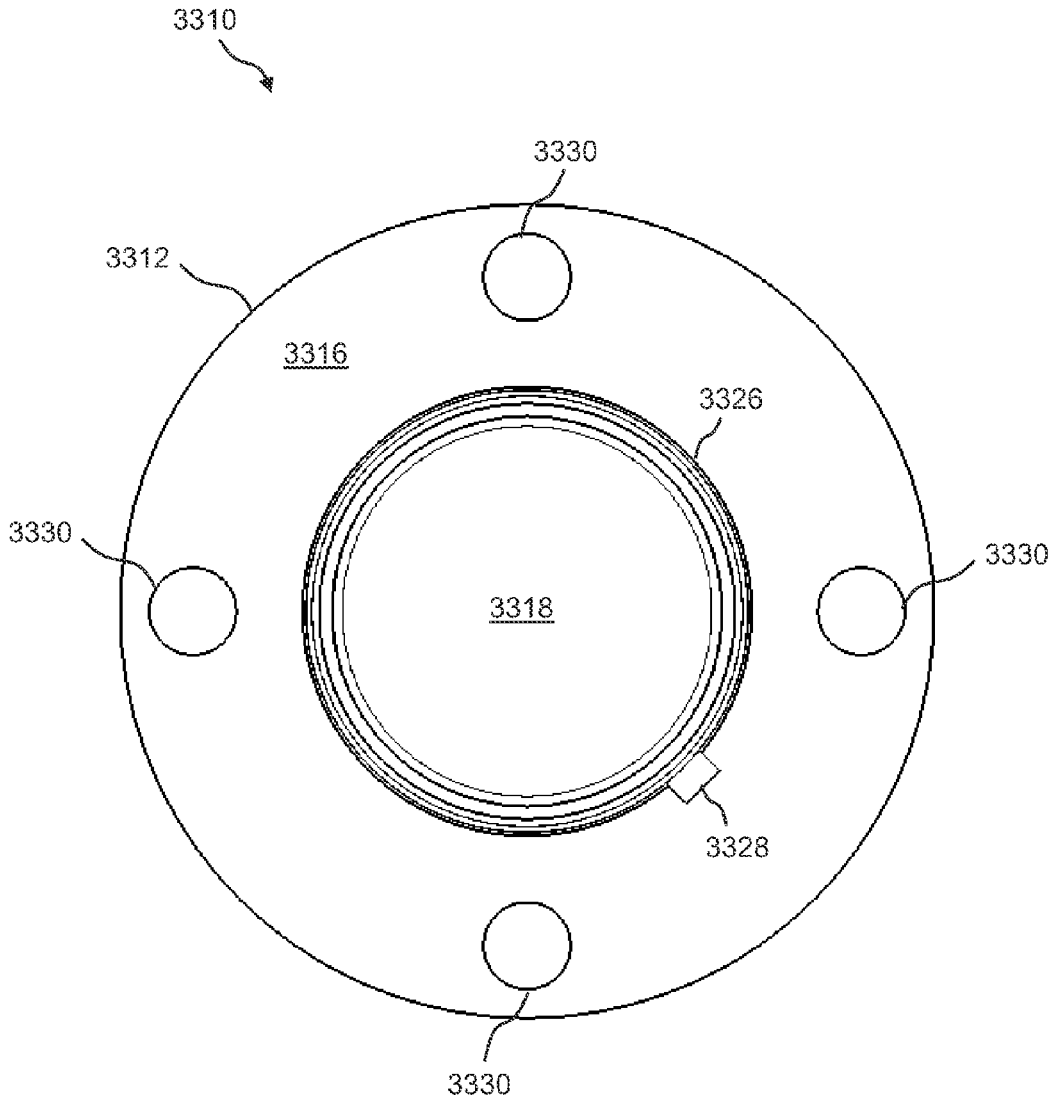
Figure 39:
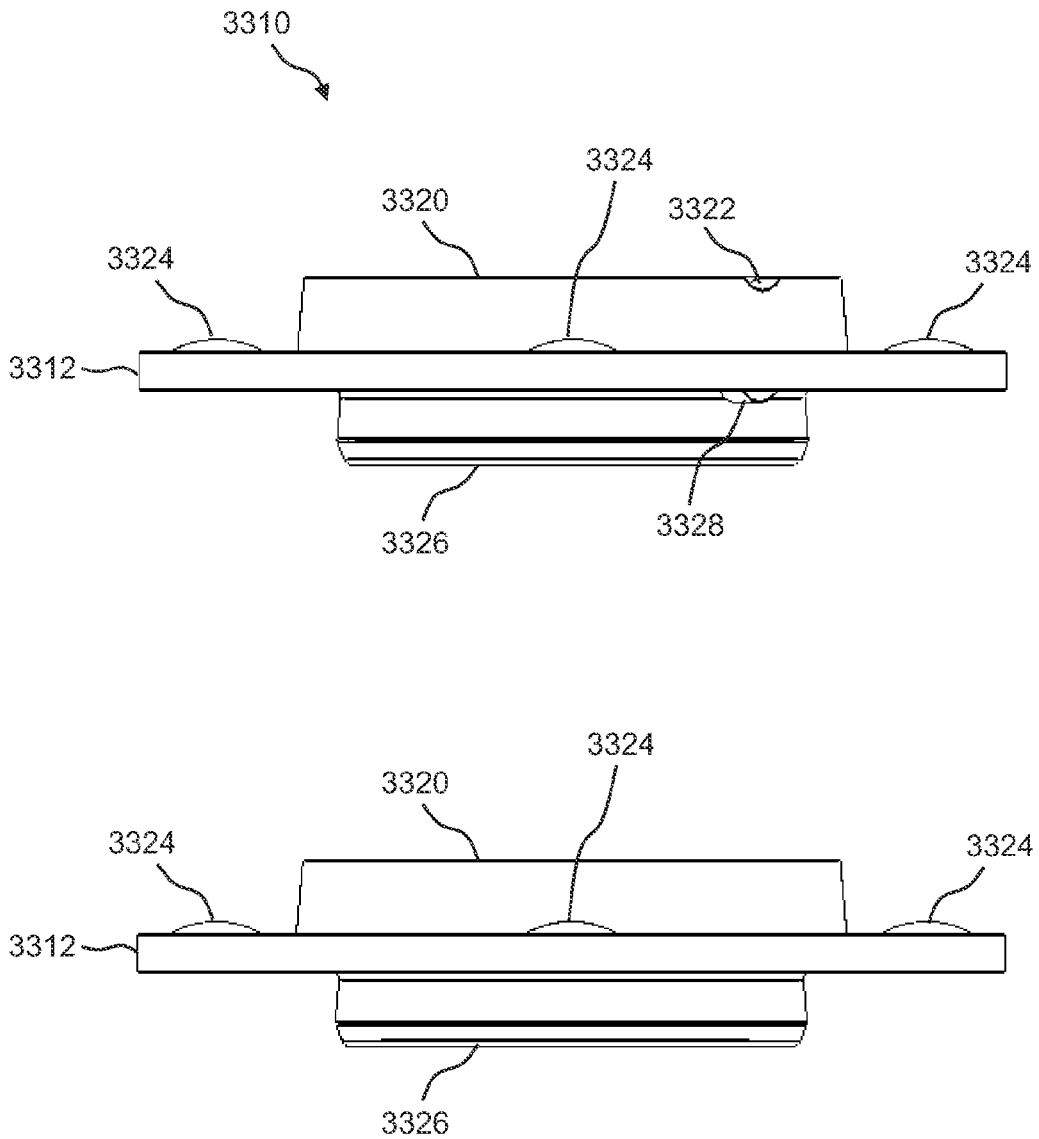
Figure 40:
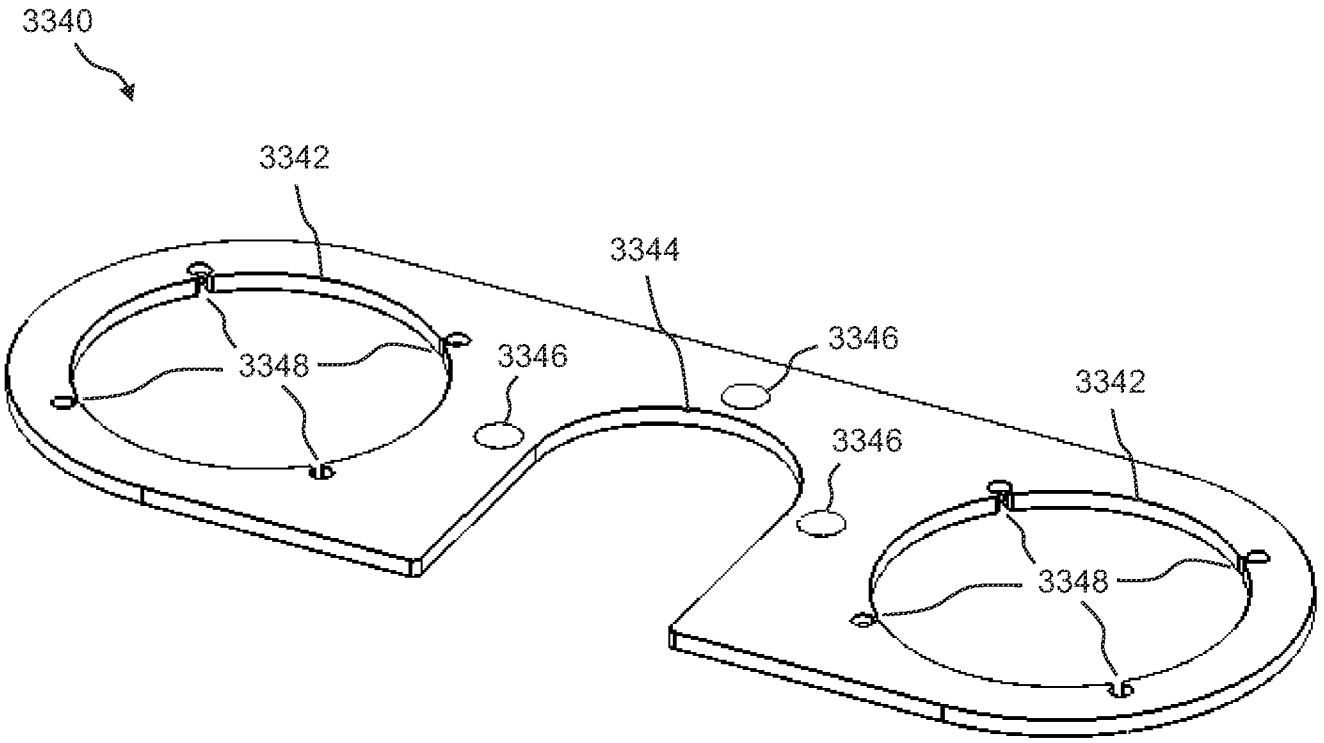
Figure 41:
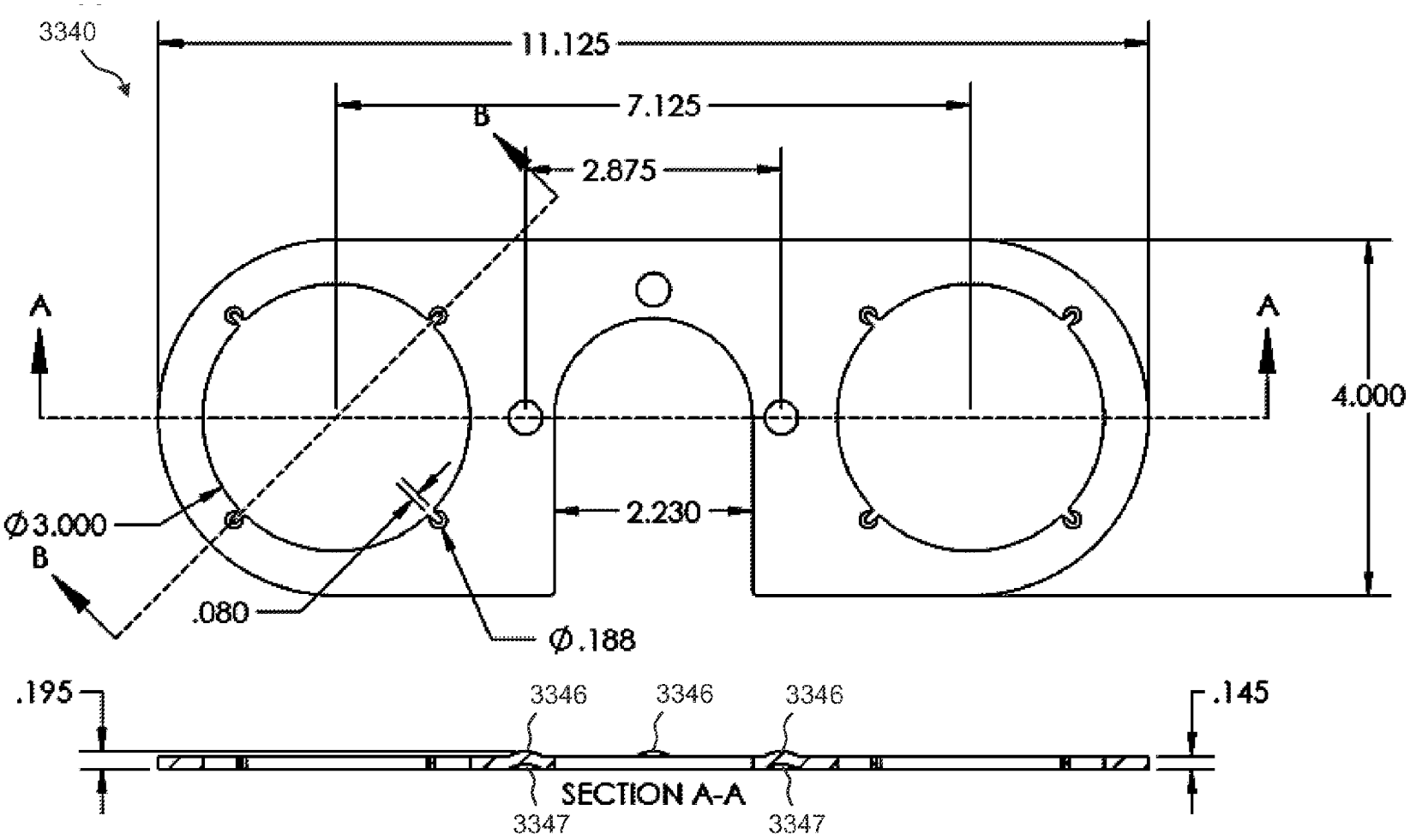
Figure 42A:
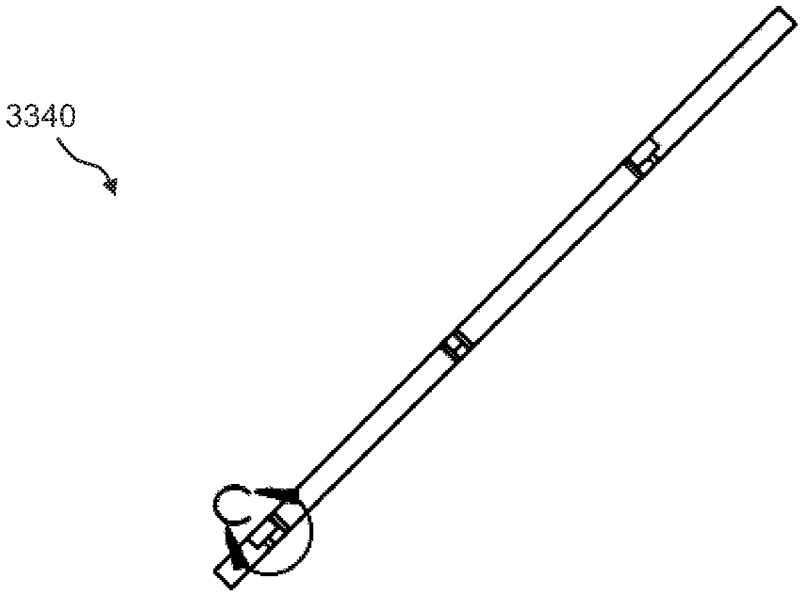
Figure 42B:
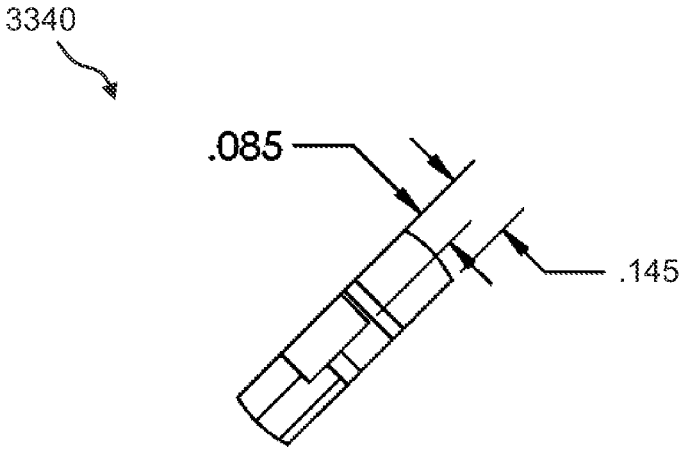
Figure 43A:
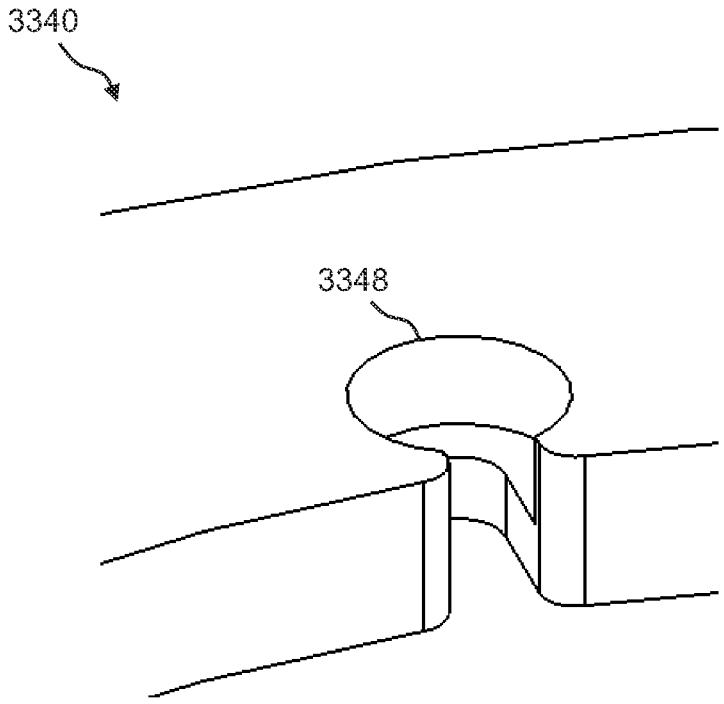
Figure 43B:
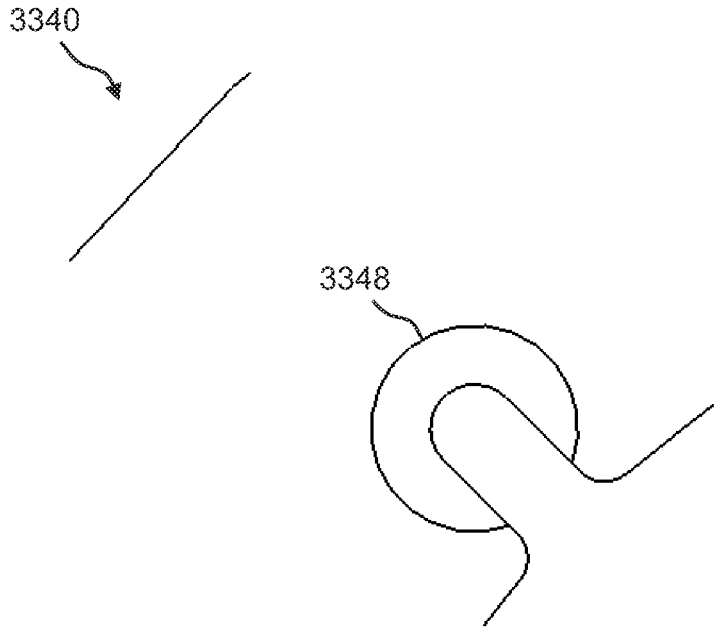

In umbrella-mounted cup holder system 3300, the two pole mounts 3310 may be fastened permanently to, for example, the pole 3305. The space between the two pole mounts 3310 is such that the 2-cup plates 3340*a* and 3340*b* can be easily snapped therebetween for use and then easily removed when not in use. When the 2-cup plates 3340*a* and 3340*b* are not in use, the two pole mounts 3310 are designed such that they do not impede the collapsing of the umbrella for storage. FIG. 34 and FIG. 35 show a perspective view and a side view, respectively, of the two pole mounts 3310 (e.g., pole mounts 3310*a*, 3310*b*) alone on the pole 3305, without the 2-cup plates 3340*a*, 3340*b* installed therebetween.

Referring now to FIG. 36 through FIG. 39, various views of the pole mount 3310 showing more details thereof are presented. The pole mount 3310 is a ring-shaped bracket that may include features wherein one pole mount 3310 can be mated to another pole mount 3310 and further include features for snap-fitting the 2-cup plates 3340*a*, 3340*b* between two pole mounts 3310. For example, the pole mount 3310 may include a disc-shaped plate 3312 that has a first side 3314 and a second side 3316. There is an opening 3318 in the plate 3312 through which a beach umbrella pole, such as the pole 3305, can be fitted. The opening 3318 may therefore sized to fit a standard beach umbrella pole.

On the first side 3314 of the plate 3312 there may be a protruding ridge or rim 3320 that has an alignment feature 3322 integrated therein. In this example, the alignment feature 3322 is a small recessed area or detent. A set of dome features 3324 may be provided on the surface of the first side 3314 of the plate 3312 and outside of the rim 3320. In one example, there are four dome features 3324. Each of the dome features 3324 can be, for example, about 0.4 inches in diameter and about 0.05 inches high.

On the second side 3316 of the plate 3312 there may be a protruding ridge or rim 3326 that has a smaller diameter than the rim 3320 on the first side 3314 of the plate 3312. As a result, there may be a shelf 3332 in the pole mount 3310. Further, there may be an alignment feature 3328 on the surface of the second side 3316 of the plate 3312 and near the rim 3326. In this example, the alignment feature 3322 is a small bump that is shaped to be fitted into the alignment feature 3322 on the first side 3314 of the plate 3312. A set of detent of dimple features 3330 may be provided on the surface of the second side 3316 of the plate 3312 and outside of the rim 3326. In one example, there are four detent of dimple features 3330. Each of the detent of dimple features 3330 can be, for example, about 0.4 inches in diameter and about 0.05 inches deep.

Referring again to FIG. 34 and FIG. 35, in one example of the umbrella-mounted cup holder system 3300, the first pole mount 3310 (e.g., the pole mount 3310*a*) is fastened to, for example, the pole 3305 using, for example, a stainless steel screw. Then the second pole mount 3310 (e.g., the pole mount 3310*b*) is positioned on the pole 3305 and against the pole mount 3310*a*. Namely, the smaller rim 3326 of the pole mount 3310*a* is fitted into the larger rim 3320 of the pole mount 3310*b*. Further, the alignment feature 3322 on the first side 3314 of the plate 3312 of the pole mount 3310*b* is fitted against the alignment feature 3328 on the second side 3316 of the plate 3312 of the pole mount 3310*a*. In this way, a certain orientation of the dome features 3324 and the dimple features 3330 is ensured. Namely, the dimple features 3330 of the pole mount 3310*a* are substantially aligned with the dome features 3324 of the pole mount 3310*b*. Again, the pole mount 3310*b* can be coupled to the pole 3305 using, for example, a stainless steel screw. In one example, when installed on the pole 3305 the gap between the second side 3316 of the plate 3312 of the pole mount 3310*a* and the first side 3314 of the plate 3312 of the pole mount 3310*b* is about 0.3 inches. This gap is configured to receive the 2-cup plates 3340*a*, 3340*b*.

In this example, the dimple features 3330 of the pole mount 3310*a* and the dome features 3324 of the pole mount 3310*b* are designed to correspond with features on the 2-cup plates 3340*a*, 3340*b*, which allow the 2-cup plates 3340*a*, 3340*b* to be snap-fitted between the pole mounts 3310*a*, 3310*b*.

Referring now to FIG. 40 through FIG. 43B, various views showing more details of the 2-cup plate 3340 are provided. The 2-cup plate 3340 may be an elongated plate that includes the two cup holes 3342 and the slot 3344. In one example, the length of the 2-cup plate 3340 is about 11.125 inches, the width of the 2-cup plate 3340 is about 4 inches, the thickness of the 2-cup plate 3340 is about 0.145 inches, and the diameter of the cup holes 3342 is about 3 inches.

A set of dome features 3346 may be provided on one side of the 2-cup plate 3340 (see FIG. 40 and FIG. 41) and arranged near the slot 3344, as shown. In one example, there are three dome features 3346. Each of the dome features 3346 can be, for example, about 0.4 inches in diameter and about 0.05 inches high. A set of dimple features 3347 (not visible in FIG. 40, see Section A-A of FIG. 41) may be provided on the other side of the 2-cup plate 3340 and opposite the dome features 3346. In one example, there are three dimple features 3347. Each of the dimple features 3347 can be, for example, about 0.4 inches in diameter and about 0.05 inches deep.

To install the 2-cup plates 3340 between the pair of pole mounts 3310, the user slides the two 2-cup plates 3340 between the pair of pole mounts 3310, then rotates each of the 2-cup plates 3340 until the dome features 3346 and the dimple features 3347 of the 2-cup plates 3340 align with each other and align with the dimple features 3330 and the dome features 3324 of the pole mounts 3310. Proper alignment may be indicated to the user by the sound and feel of the features snapping together.

Figure 44:
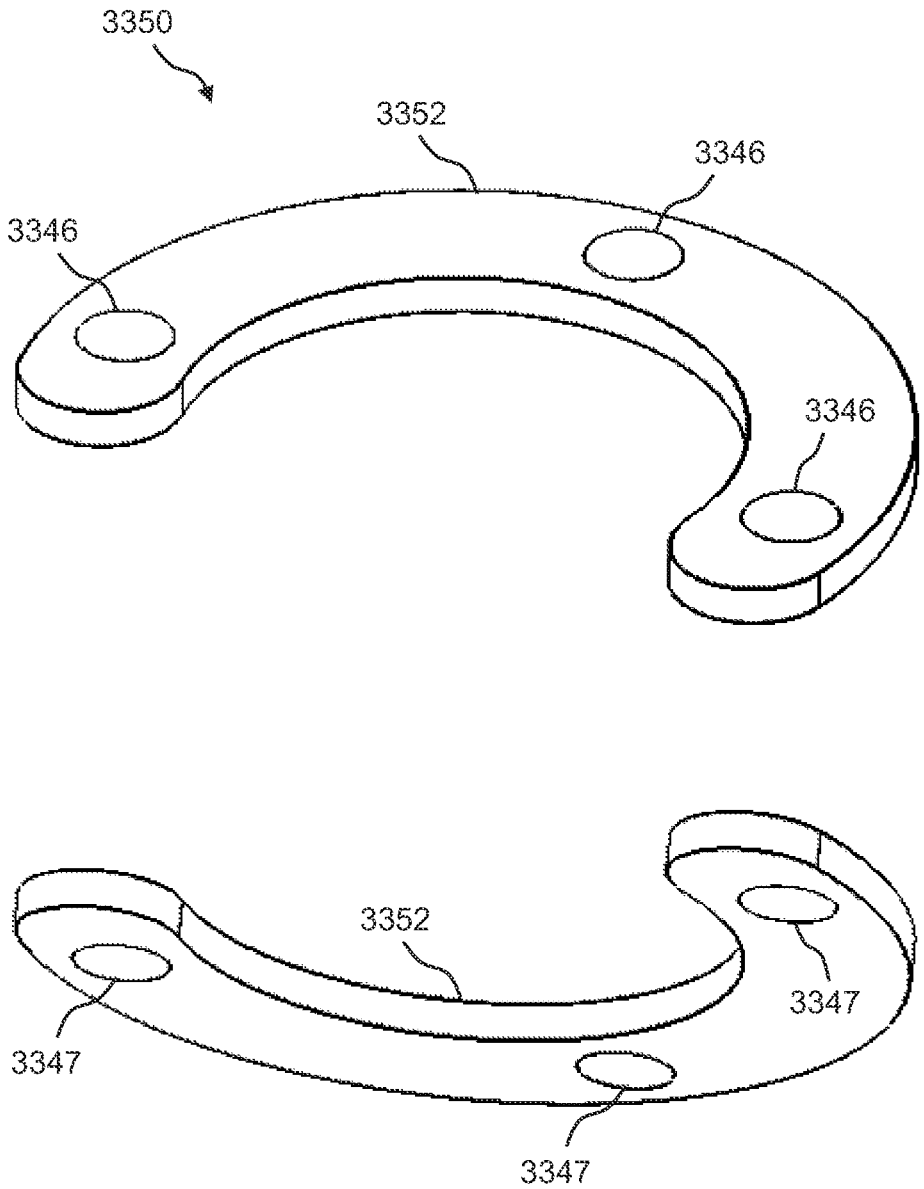

In another embodiment of the umbrella-mounted cup holder system 3300, instead of using two 2-cup plates 3340 between the pole mounts 3310, one 2-cup plate 3340 and a spacer may be installed between the pole mounts 3310. Namely, in this example, one of the 2-cup plates 3340 is replaced with a spacer. Referring now to FIGS. 44 and 45, various views of an example of a spacer 3350 that can be used in place of one of the 2-cup plates 3340 are presented. The spacer 3350 can be substantially the same thickness as the 2-cup plate 3340. In this example, the spacer 3350 includes a horseshoe-shaped plate 3352 that also includes the dome features 3346 and the dimple features 3347 as described with reference to the 2-cup plates 3340 in FIG. 40 and FIG. 41.

In this example, to install the 2-cup plate 3340 and the spacer 3350 between the pair of pole mounts 3310, the user may slide the 2-cup plate 3340 and the spacer 3350 between the pair of pole mounts 3310, then rotate the 2-cup plate 3340 and the spacer 3350 until the dome features 3346 and the dimple features 3347 of the 2-cup plate 3340 and the spacer 3350 align with each other and align with the dimple features 3330 and the dome features 3324 of the pole mounts 3310. Proper alignment is indicated to the user by the sound and feel of the features snapping together.

Further, a set of locking features 3348 may be provided around the edge of the two cup holes 3342 in the 2-cup plate 3340. In one example, there are four locking features 3348 at each cup hole 3342. FIG. 42A, 42B, 43A, and 43B show more details of the locking feature 3348. The locking features 3348 are designed to receive certain accessories that can be used with the presently disclosed umbrella-mounted cup holder system 3300.

Referring now to FIG. 46, FIG. 47, and FIG. 48, various views of examples of accessories that can be used with the umbrella-mounted cup holder system 3300 of FIG. 33 through FIG. 45 are presented. In one example accessory, a hook 3360 is shown in FIG. 46. The hook 3360 includes a hook member 3362, the top of which has a knob feature 3364. The hook 3360 can be formed, for example, of molded plastic. The knob feature 3364 of the hook 3360 is designed to be snap-fitted into any one of the locking features 3348 of the cup holes 3342 in the 2-cup plate 3340. The hook 3360 can be used, for example, for hanging keys or sunglasses from the umbrella-mounted cup holder system 3300. Multiple hooks 3360 can be used with the umbrella-mounted cup holder system 3300.

In another example accessory, a bendable spline 3370 is shown in FIG. 47. The bendable spline 3370 includes a strong string-like member 3372 that has joints 3374 at certain positions along its length. Each end of the string-like member 3372 has a knob feature 3374. The bendable spline 3370 can be formed, for example, of molded plastic. The knob features 3374 of the bendable spline 3370 are designed to be snap-fitted into two opposite locking features 3348 of the cup holes 3342 in the 2-cup plate 3340. The bendable spline 3370 provides a stirrup like mechanism for holding, for example, a bottle in the cup holes 3342. Namely, the bottle can rest on the bendable spline 3370, which prevents the bottle from falling through the cup hole 3342. The bendable spline 3370 can be provided, for example, in one or both of the cup holes 3342 in the 2-cup plate 3340.

In yet another example accessory, a pouch 3380 is shown in FIG. 48. The pouch 3380 includes, for example, a first web 3382 and a second web 3384, which can form the sides of the pouch 3380. Multiple knob features 3386 are provided around the edges of the first web 3382 and the second web 3384. The pouch 3380 can be formed, for example, of molded plastic. The knob features 3386 of the pouch 3380 are designed to be snap-fitted into the locking features 3348 of the cup holes 3342 in the 2-cup plate 3340 in a manner that forms a pouch for holding, for example, a wallet, a cellphone, or sunglasses.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A shaft mounted cup holder assembly, comprising:

a. one or more cup holder plates comprising one or more cut-outs configured for holding a drinking cup, and a central region comprising a center cut-out; and b. a central fastener, the fastener comprising an upper coupler, a lower coupler, and a central cutout region;

wherein the one or more plates are positioned between the upper coupler and the lower coupler, thereby aligning the center cut-out of the one or more plates and the central cut-out region of the fastener such that the cup holder assembly may receive a shaft therethrough;

and further wherein the one or more plates further comprise locking features configured to receive removable cup holder accessories and the cup holder accessories comprise a hook, bendable spline, and a pouch wherein the hook, bendable spline and pouch are removably engaged with the locking features.

2. The cup holder assembly of claim 1, wherein the one or more plates comprises two or more plates and the two or more plates are stacked and oriented substantially orthogonal to one another.

3. The cup holder assembly of claim 1, wherein the one or more plates are substantially rectangular.

4. The cup holder assembly of claim 1, wherein the one or more plates are substantially cross shaped.

5. The cup holder assembly of claim 1, wherein the one or more plates are substantially circular.

6. The cup holder assembly of claim 1, further comprising a. a base plate disposed in spaced relation to the one or more cup holder plates, and b. a spacer disposed between the first plate and the base plate.

7. The cup holder assembly of claim 1, further comprising a shaft, wherein the shaft extends through the cup holder assembly and the cup holder assembly is affixed thereto.

8. The cup holder assembly of claim 7, further comprising a base.

9. The cup holder assembly of claim 8, wherein the base is weighted and configured to rest upon a surface.

10. The cup holder assembly of claim 8, wherein the base is configured to be installed in a surface such that the shaft and cup holder assembly may be removably installed therein.

11. The cup holder assembly of claim 1, wherein the one or more plates and the fastener comprise snap features configured to enable the one or more plates to be installed in, and subsequently removed from, the fastener.

12. A shaft mounted cup holder assembly, comprising a. one or more cup holder plates comprising one or more cut-outs configured to hold a drinking cup;

b. a central fastener comprising an upper coupler, a lower coupler, and a central cutout region;

wherein the one or more plates are configured to couple to the fastener and the central cut-out region is configured to receive a shaft therethrough;

and further wherein the one or more plates further comprise locking features configured to receive removable cup holder accessories and the cup holder accessories comprise a hook, bendable spline, and a pouch wherein the hook, bendable spline and pouch are removably engaged with the locking features.

13. A shaft mounted cup holder assembly, comprising a. one or more cup holder plates comprising one or more cut-outs configured for holding a drinking cup, and a central region comprising a center cut-out;

b. a central fastener, the fastener comprising an upper coupler, a lower coupler, and a central cutout region;

c. a shaft configured for insertion in a hole in a surface;

wherein the one or more plates are positioned between the upper coupler and the lower coupler, thereby aligning the center cut-out of the one or more plates and the central cut-out region of the fastener such that the cup holder assembly may receive the shaft therethrough and securely sit upon the surface;

and further wherein the one or more plates further comprise locking features configured to receive removable cup holder accessories and the cup holder accessories comprise a hook, bendable spline, and a pouch wherein the hook, bendable spline and pouch are removably engaged with the locking features.

14. A shaft mounted cup holder assembly, comprising a. one or more cup holder plates comprising one or more cut-outs configured for holding a drinking cup, and a central region comprising a center cut-out;

b. a central fastener, the fastener comprising an upper coupler, a lower coupler, and a central cutout region;

c. a base; and d. a shaft configured for insertion in the base;

wherein the one or more plates are positioned between the upper coupler and the lower coupler, thereby aligning the center cut-out of the one or more plates and the central cut-out region of the fastener such that the cup holder assembly may receive the shaft therethrough and securely couple to the base;

and further wherein the one or more plates further comprise locking features configured to receive removable cup holder accessories and the cup holder accessories comprise a hook, bendable spline, and a pouch wherein the hook, bendable spline and pouch are removably engaged with the locking features.

* * * * *